US005405212A

United States Patent [19]

Swisher, Jr. et al.

[11] Patent Number: 5,405,212

[45] Date of Patent: * Apr. 11, 1995

[54] PAVING MACHINE WITH DROP-THEN-STOP DOWEL BAR INSERTION

[75] Inventors: George W. Swisher, Jr., Oklahoma City; Don W. Smith, Edmond, both of Okla.

[73] Assignee: CMI Corporation, Oklahoma City, Okla.

[ * ] Notice: The portion of the term of this patent subsequent to Jun. 7, 2011 has been disclaimed.

[21] Appl. No.: 207,495

[22] Filed: Mar. 7, 1994

Related U.S. Application Data

[63] Continuation-in-part of Ser. No. 900,878, Jun. 16, 1992, Pat. No. 5,318,377.

[51] Int. Cl.[6] ..... E01C 23/04

[52] U.S. Cl. ..... 404/74; 404/88; 404/100

[58] Field of Search ..... 404/74, 88, 100

[56] References Cited

U.S. PATENT DOCUMENTS

| | | | |
|---|---|---|---|
| 2,596,206 | 5/1952 | Carnes | 94/39 |
| 3,068,766 | 12/1962 | Houck | 94/51 |
| 3,083,621 | 4/1963 | Woolley et al. | 94/39 |
| 3,334,559 | 8/1967 | Taylor | 94/39 |
| 3,443,495 | 5/1969 | Heltzel | 94/39 |
| 3,774,401 | 11/1973 | Allen | 60/420 |
| 3,779,662 | 12/1973 | Smith | 404/98 |
| 3,970,405 | 7/1976 | Swisher, Jr. et al. | 404/105 |
| 4,168,135 | 9/1979 | Johansson et al. | 425/64 |
| 4,433,936 | 2/1984 | Moser | 404/88 |
| 4,493,584 | 1/1985 | Guntert | 404/74 |
| 4,798,495 | 1/1989 | Läeuppi et al. | 404/100 |
| 4,799,820 | 1/1989 | Laeuppi et al. | 404/100 |
| 4,995,758 | 2/1991 | Smith | 404/88 |
| 5,190,397 | 3/1993 | Bengford et al. | 404/88 |
| 5,209,602 | 5/1993 | Godbersen | 404/88 |

FOREIGN PATENT DOCUMENTS

| | | | |
|---|---|---|---|
| 573007 | 12/1958 | Belgium . | |
| 2446768 | 4/1976 | Germany . | |
| 3117544 | 11/1982 | Germany . | |
| 154761 | 9/1985 | Germany . | |
| 3907643 | 10/1990 | Germany | 404/88 |
| 1390491 | 4/1975 | United Kingdom . | |
| 195485 | 8/1967 | U.S.S.R. . | |
| 247993 | 1/1970 | U.S.S.R. . | |

*Primary Examiner*—William P. Neuder
*Attorney, Agent, or Firm*—Dunlap & Codding

[57] ABSTRACT

A paving machine having a medially located dowel bar feeder positioned in front of a dowel bar inserter. The machine has a screw or paddle for spreading the concrete and a front strike-off to allocate a proper amount of unconsolidated concrete beneath the machine. Next in line, internal vibrators are mounted to the machine to perform a preliminary consolidation of the concrete, followed by a screed to meter out a correct volume of consolidated concrete for a finished concrete slab. To the rear of the screed, the dowel bar feeder drops dowel bars in a predetermined pattern on the top surface of the consolidated concrete. The dowel bar inserted is mounted to the paving machine behind the dowel bar feeder and includes a plurality of vibrating forks which descend to engage the dropped dowel bars and insert the dowels into the unhardened concrete. In operation, the dowel bars are dropped and the paving machine is driven forward until the forks are over the dropped dowel bars. The paving machine is then stopped and the forks are lowered to insert the dowel bars into the concrete. A finishing machine is operated behind the paving machine to insert center bars and to produce a final consolidated and smoothed grade in the concrete. The paving machine may be adapted to insert dowel bars for transverse joints in a straight or a skewed pattern. In the case of the straight pattern, all the dowel bars for each transverse joint are dropped at the same time. For the skewed pattern, the dowel bars for each transverse joint are dropped one at a time.

28 Claims, 17 Drawing Sheets

PAVING MACHINE WITH DROP-THEN-STOP DOWEL BAR INSERTION

Cross-Reference to Related Applications

This application is a continuation-in-part of U.S. Ser. No. 07/900,878, filed Jun. 16, 1992, now entitled U.S. Pat. No. 5,318,377 and entitled "Paving Machine With Midline Dowel Bar Insertion."

BACKGROUND OF THE INVENTION

1. Field of the Invention The present invention relates to paving machines which insert dowel bars into the new concrete pavement.

2. Description of Related Art

Over the years, various designs for paving machines which insert dowel bars have been developed. One goal in designing such machines is to achieve proper dowel bar placement in the new concrete while keeping manual labor and disturbance of the concrete to a minimum.

German Patent No. 3,117,544 issued to Vögele, for example, discloses a machine which forms recesses in the concrete and then buries the dowels with concrete. Unless the desired depth for the dowels is very shallow, this machine has to move a large volume of concrete in order to form the recesses and cover up the dowels. Disturbing so much concrete is inefficient and increases the likelihood of creating voids in the concrete or of displacing the dowels from their proper position in the concrete.

U.S. Pat. No. 4,433,936 issued to Moser and U.S. Pat. No. 4,798,495 issued to Läeuppi et al. disclose a horizontal frame of dowels with inserting guides or prongs positioned above the horizontal frame to drive the dowels downward through openings in the horizontal frame and into the concrete. By linking the horizontal frame of dowels and the inserting guides, the dowel insertion process is tightly restricted by the dowel feeding mechanism. A slight jam or mishap in feeding the dowels is likely to require stopping the machine, positioning some of the dowels by hand and attempting to smooth the concrete manually.

Another drawback is that dowel insertion devices are sometimes attached to the rear of a paving machine and the dowel insertion disturbs a graded, smoothed surface. Once the surface is disturbed by inserting the dowels, it must be smoothed again. Oscillating beams, sometimes used to smooth the surface after dowel insertion, cannot duplicate the paving job performed by the tube vibrator, tamping bar, extrusion pan and float pan of a paving machine.

The problem areas addressed by the present invention, therefore, relate to excessive disturbance of the concrete, difficulties in feeding dowels to the inserting mechanism, and the effort required to obtain a final, smooth concrete surface after dowel insertion.

SUMMARY OF THE INVENTION

A paving machine constructed in accordance with the present invention comprises a mobile frame with a forward end and a rearward end. Mounted to the frame are various assemblies for building a concrete surface.

Moving from the forward end of the frame to the rearward end of the frame, the road construction assemblies include a screw or paddle, front strike-off, internal vibrators, concrete metering screed, dowel bar feeder, dowel bar inserter, a center bar inserter, surface tube vibrators, tamping bar, extrusion pan, and float pan. A programmable logic controller is provided to control and coordinate the dowel bar feeding and inserting processes.

In an alternate embodiment, the present invention comprises a paving machine coupled with a finishing machine. The paving machine includes a frame, a screw or paddle, a front strike-off, internal vibrators, a concrete metering screed, a dowel bar feeder and a dowel bar inserter.

The dowel bar inserter is mounted to the frame of the paving machine such that it has no front-to-rear motion with respect to the frame. Moreover, the paving machine is stopped while the dowel bars are inserted. While the dowel bars are inserted, hydraulic power of the paving machine is diverted from the drive system to the dowel bar inserter.

The finishing machine is coupled to the rear of the paving machine and includes a center bar inserter, surface tube vibrators, tamping bar, extrusion pan, and float pan. A distance sensor is connected to the control systems of the paving machine and the finishing machine to maintain the spacing between the two machines within predetermined distance limits.

A principal object of the present invention is to provide a paving machine which inserts dowels into the concrete before the concrete slab is finished by the tamping bar and extrusion pan, This sequence of operations alleviates the problem with paving machines which finish the concrete surface, insert the dowel bars and then attempt to repair the damage done to the concrete surface by the insertion process, Another object of the present invention is provide a dowel bar feeding mechanism which is separate from the dowel bar inserter and which assures continuous operation of the dowel bar insertion process, Other advantages and features of the present invention are apparent from the following detailed description when read in conjunction with the accompanying drawings and appended claims,

BRIEF DESCRIPTION OF THE DRAWINGS

FIG. 6 is a view of the dowel bar feeder taken along the lines 6—6 of FIG. 4.

FIG. 9 is a logic diagram of the outputs of the programmable logic controller of the paving machine.

FIG. 19 is a partly diagrammatical side view of a paving machine and finishing machine constructed in accordance with the present invention.

DETAILED DESCRIPTION OF THE PREFERRED EMBODIMENTS

Figure 1:
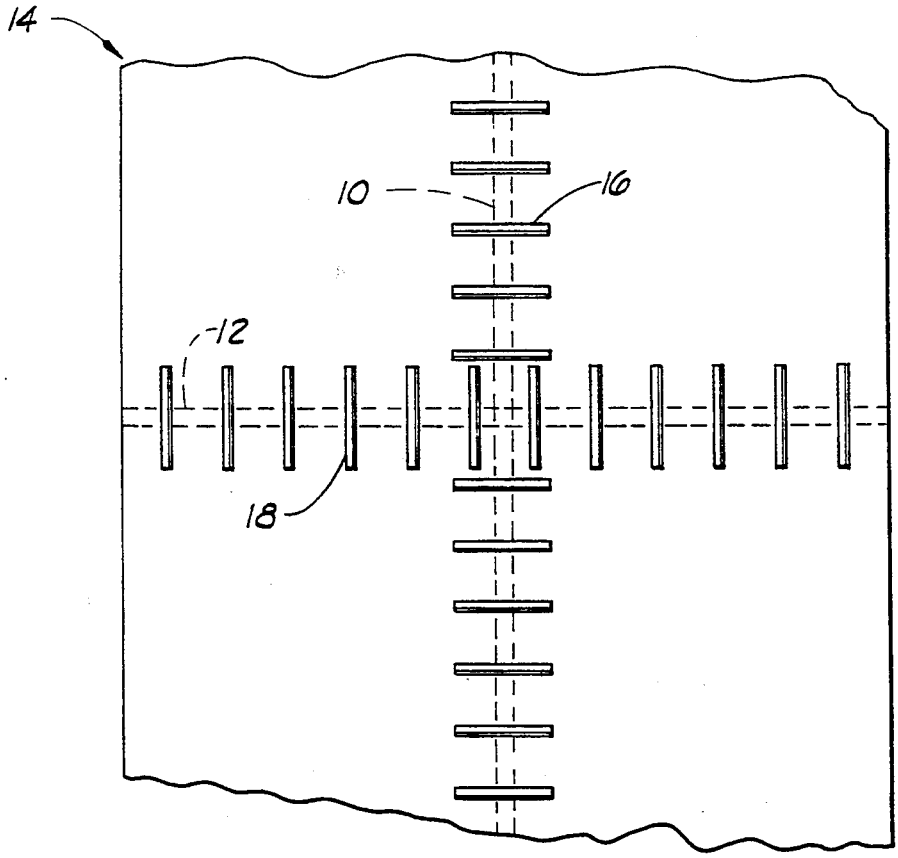
FIG. 1 is a diagrammatical view of a portion of a pavement constructed with dowel bars in a straight pattern.
Figure 2:
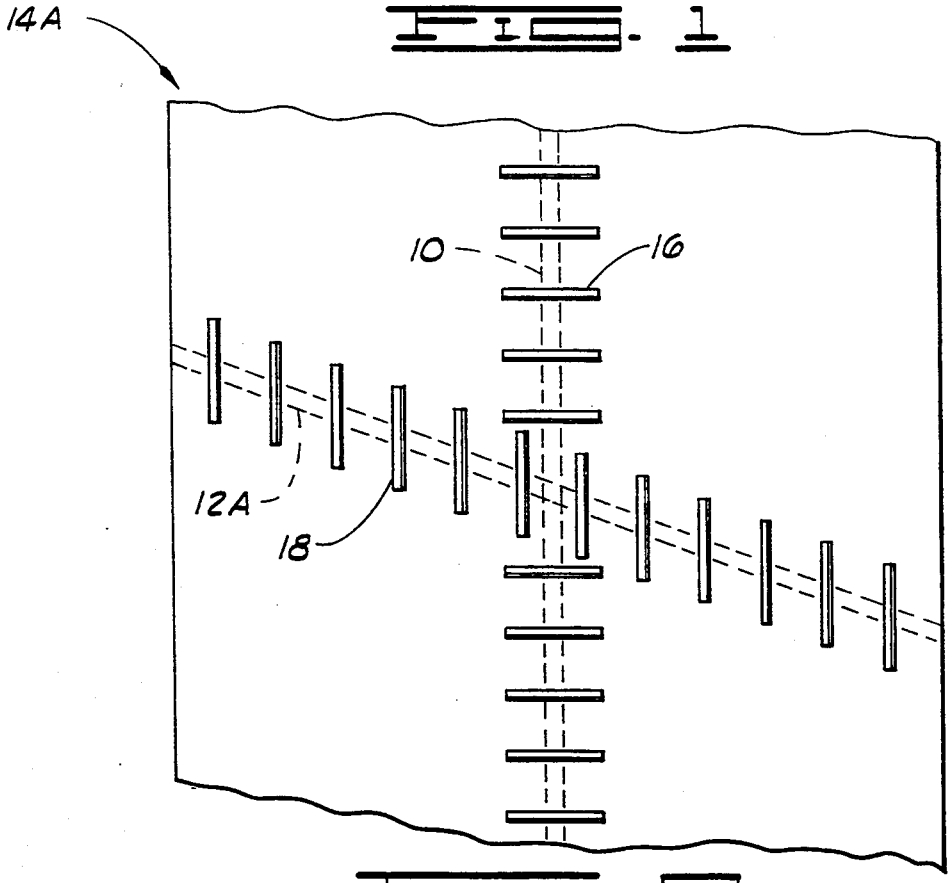
FIG. 2 is a diagrammatical view of a portion of a pavement constructed with dowel bars in a skewed pattern.
Figure 1:
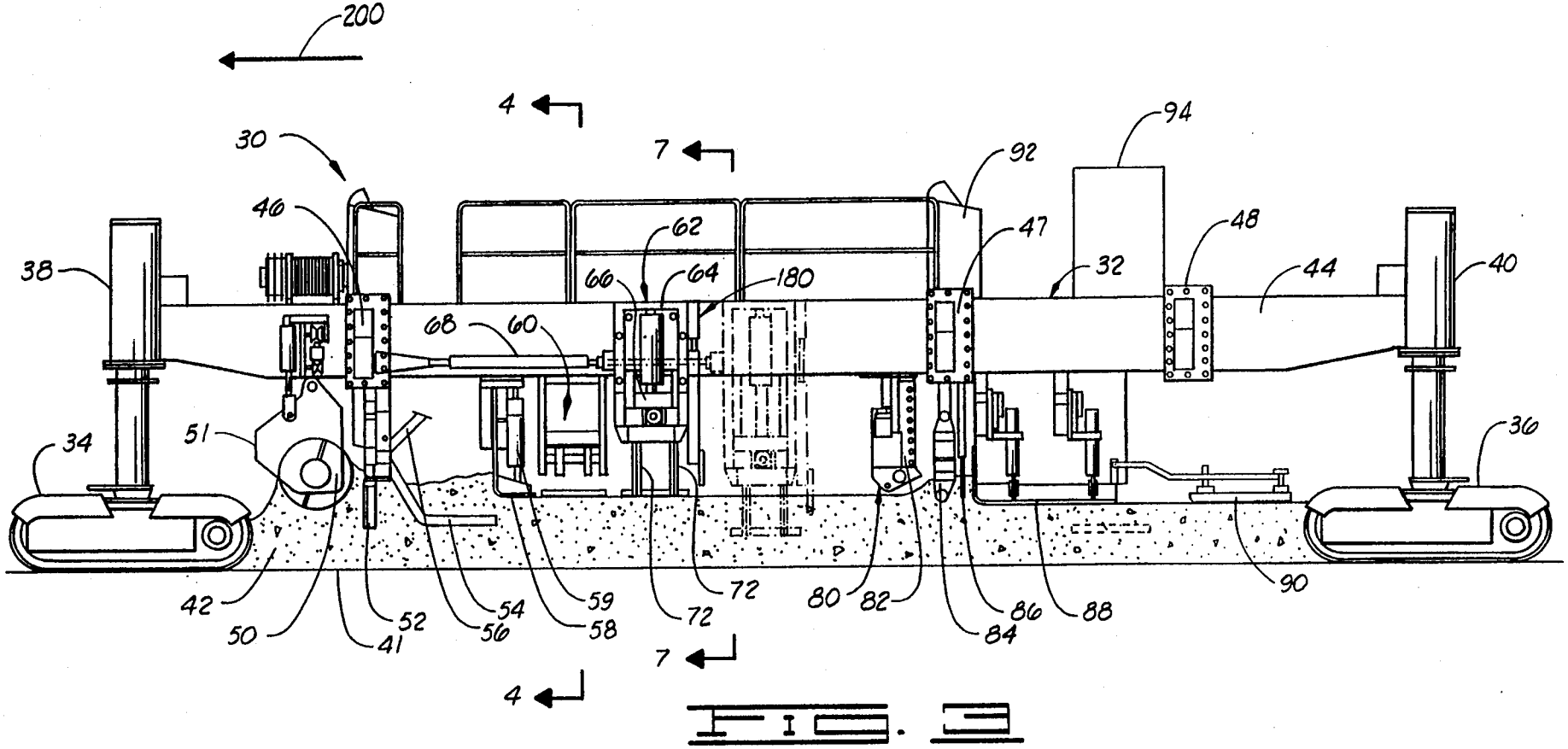

Referring now to FIGS. 1 and 2, two types of road construction with dowel bars are described. It should be understood that size of the joints and bars of FIGS. 1 and 2 are exaggerated for purposes of illustration. Turning first to FIG. 1, a lengthwise joint 10 and a transverse joint 12 (both indicated by broken lines) are cut in a concrete pavement 14 to allow the concrete to expand and contract without breaking.

The lengthwise joint 10 is cut at the center of the pavement 14 and extends for the length of the pavement 14 to allow the concrete to expand and contract laterally. In order to reinforce the lengthwise joint 10, bars are placed in the concrete to extend across the joint 10. For the purposes of this disclosure the bars in the length-wise joint 10 are referred to as "center bars." One of the center bars is designated by reference number 16 and is generally representative of the center bars of the pavement 14.

Transverse joints, one of which is indicated by reference number 12, are cut across the pavement 14 at designed intervals to allow the concrete to expand and contract longitudinally. Bars are also installed in the concrete to span and reinforce each transverse joint 12. In this disclosure, the bars placed in the transverse joints 12 are referred to as "dowel bars." One of the dowel bars is designated by reference numeral 18 and is generally representative of the dowel bars placed in transverse joints 12.

The width of the pavement 14, the interval of the transverse joints 12 and the Spacing of the center bars 16 and dowel bars 18 may vary according to design and construction requirements. As an example, however, a typical pavement may be 24-feet wide with transverse joints 12 every 15 feet. Such a pavement may have the dowel bars 18 spaced one foot apart with the two outside dowel bars positioned six inches from the side of the pavement. Therefore, the 24-foot wide pavement would have 23 dowel bars 18 on one-foot centers in each transverse joint 12.

The dowel bars 18 are typically 18 to 20 inches long. One half of each dowel bar 18 is normally coated with epoxy to prevent that half of the bar from adhering to the concrete as the concrete hardens. After the concrete sets up, the end of the dowel bar 18 with the epoxy coating, is free to move in and out of the adjacent section as the concrete expands and contracts.

The center bars 16 may be installed at various spacings from one another. It is common, however, to place the center bars 16 in the concrete on 30-inch centers. It should be appreciated that the center bars 16 and dowel bars 18 are inserted into unhardened concrete and that the lengthwise joints 10 and transverse joints 12 are cut after the concrete hardens. After the joints 10 and 12 are cut, mastic is placed into the joints 10 and 12 to provide an even road surface over the joints 10 and 12.

A typical pavement 14 may be from 6 to 20 inches thick. The center bars 16 and dowel bars 18 are generally positioned approximately halfway into the depth of the concrete slab.

In some cases it is desirable that the transverse joints be skewed rather than straight across the pavement. In other situations skewed transverse joints may be a requirement in road construction specifications.

A skewed transverse joint 12A and its dowel bars 18 are illustrated in the pavement 14A of FIG. 2. The center bars 16 are positioned in the same manner as the pavement 14 in FIG. 1. The transverse joint 12A, however, angles across the pavement 14A rather than running perpendicular to the sides of the pavement 14A. Accordingly, the dowel bars 18 installed in the transverse joint 12A are staggered rather than positioned in a row.

A machine constructed in accordance with the present invention is designed to build a pavement with center bars and dowel bars inserted. Moreover, the paving machine may be adapted to install dowel bars in either the straight or the skewed pattern.

Figure 3:
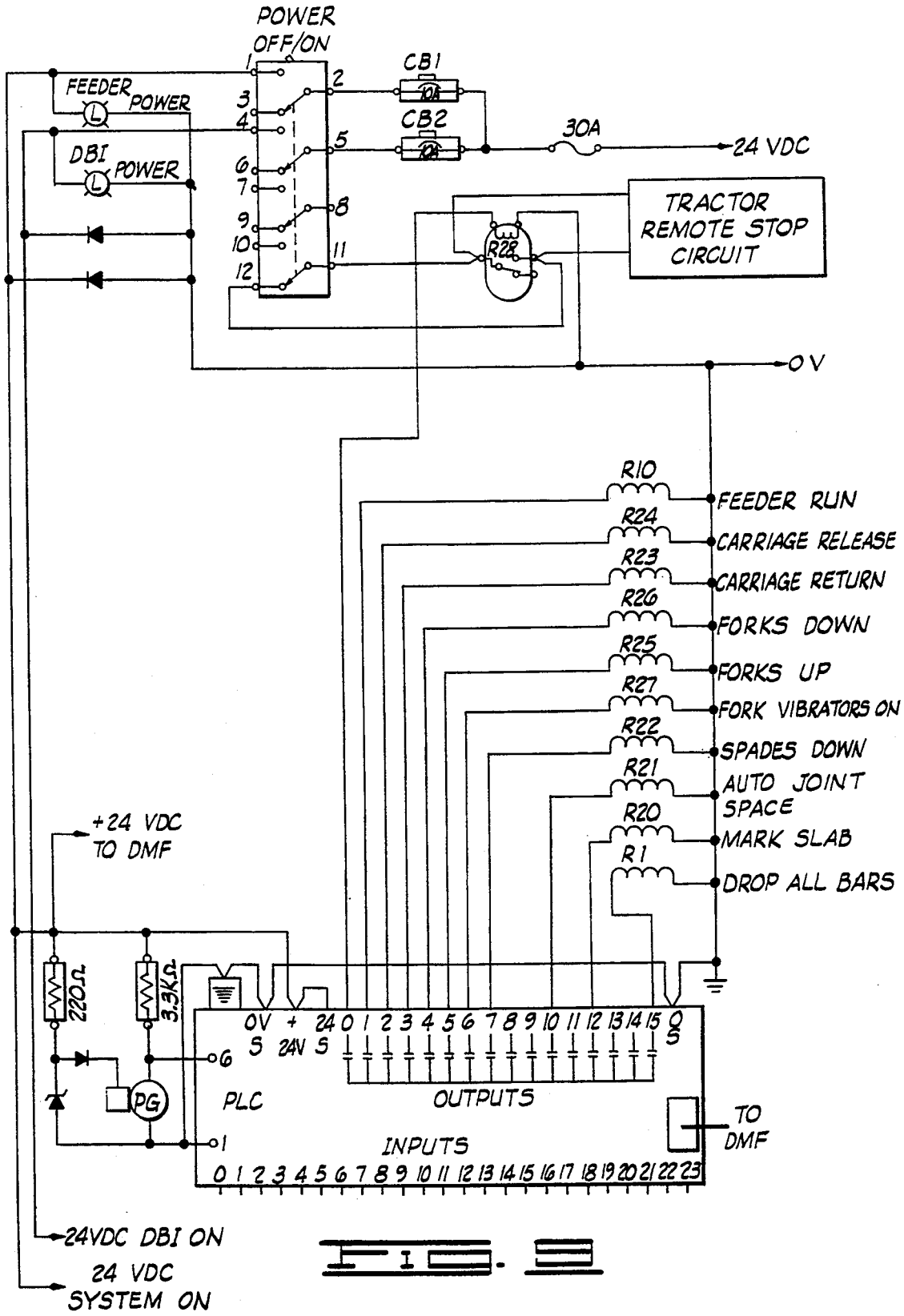
FIG. 3 is a side view of a paving machine constructed in accordance with the present invention.

Referring now to FIG. 3, reference number 30 generally designates a paving machine constructed in accordance with the present invention. The machine 30 comprises a frame 32 supported upon a front track assembly 34 and a rear track assembly 36 by a pair of front support columns 38 and a pair of rear support columns 40. The track assemblies 34 and 36 are adapted to propel the machine 30 in a conventional manner over a surface prepared for the construction of a pavement.

Concrete 42 for the pavement is poured between the tracks of the front track assembly 34. Track shields (not shown) are mounted just inside each front track to prevent the concrete from entering the front track assembly 34. The formation of the pavement and insertion of dowel bars and center bars take place along the length of the frame 32 of the machine.

The frame 32 includes a pair of side beams arranged with one side beam extending from the front column 38 to the rear column 40 on each side of the machine 30. The side beams of the frame 32 are generally designated by reference numeral 44. Three cross beams extend between the side beams 44 at intermediate points of the frame 32. The front cross beam is indicated by reference number 46, the middle cross beam is designated by reference numeral 47 and the rear cross beam is indicated by reference number 48.

With continued reference to FIG. 3, the paving components of the machine 30 are now described. A screw 50 or paddle 51 and a front strike-off 52 are mounted to the frame 32 toward the front of the paving machine 30. The screw 50 or paddle 51 proportions the concrete in front of the front strike-off 52. The front strike-off 52 is vertically adjustable to allow the correct amount of unconsolidated concrete beneath the frame 32 for forming the concrete slab.

A plurality of internal vibrators 54 is secured to the frame 32 to the rear of the front strike-off 52. The internal vibrators 54 perform an internal consolidation of the concrete. A hydraulic cylinder 56 is provided with the internal vibrators 54 to change the depth of the internal vibrators 54 in the concrete 42. As will be pointed out later in this disclosure, the initial consolidation of the concrete 42 is critical to proper insertion of the dowel bars 18.

A concrete metering screed 58 is mounted to the frame 32 behind the internal vibrators 54. The concrete metering screed 58 is vertically adjustable to meter out the correct volume of consolidated concrete for forming the finished concrete slab. The metering screed 58 also provides a preliminary leveling of the upper surface of the concrete prior to the insertion of dowel bars 18.

It should be appreciated that the metering screed 58 merely evens the surface of the concrete for the subsequent operations of the machine and does not produce a finished concrete surface. The metering screed 58 extends completely across the frame 32 to level the surface of the entire concrete slab. A hydraulic cylinder 59 is connected to the metering screed 58 to adjust the height of the metering screed 58.

Continuing to refer to FIG. 3, a dowel bar feeder 60 is mounted to the frame 32 behind the metering screed 58. The dowel bar feeder 60 includes a supply of dowel bars 18 and mechanisms for positioning dowel bars 18 over the concrete surface and dropping dowel bars 18 onto the concrete surface.

Mounted to the frame 32 next in line is a dowel bar inserter 62. As illustrated by FIG. 3, the inserter 62 comprises an inserter carriage 64 containing a fork rack 66. The inserter carriage 64 is channel-mounted on rollers to the frame 32 to travel horizontally between a forward position (shown in solid lines) and a rear position (shown in phantom lines). An inserter cylinder 68 is located on each side of the frame 32 to move the inserter carriage 64 between the forward and rear positions.

The fork rack 66 includes a plurality of forks 72 extending downward toward the concrete surface in an arrangement corresponding to the spacing pattern of the dowel bars 18. The fork rack 66 is channel-mounted on rollers within the inserter carriage 64 to travel vertically between an up and a down-position. In the up position, the forks 72 are above the surface of the concrete. In the down position, the forks 72 insert the dowel bars 18 to the desired depth in the concrete.

To the rear of the dowel bar inserter 62, a center bar inserter 80 is mounted to the frame 32. The center bar inserter 80 is similar to the apparatus disclosed by U.S. Pat. No. 4,995,758 issued on Feb. 26, 1991 to Smith, which is hereby incorporated by reference. The structure disclosed by the Smith '758 patent is modified by placing the center bar magazine 82 holding a supply of center bars 16 in a more vertical position to reduce the space requirements of the center bar inserter 80.

After the center bar inserter 80, the machine 30 has a surface tube vibrator 84, a tamping bar 86 for pushing coarse aggregate in the concrete below the surface of the concrete, an extrusion pan 88 and a float pan 90. These structures are commonly used in the industry to effect a graded, finished concrete surface.

It should be appreciated that the surface tube vibrator 84 only consolidates an upper portion of the concrete, above the depth of the dowel bars 18 and center bars 16. Extending the surface tube vibrator 84 too close to the depth of the inserted dowel bars 18 and center bars 16 would likely displace them from their proper positions.

An operator's console 92 is provided upon the frame 32. The console 92 contains controls and indicators for the steering and operation of the machine 30. An engine compartment 94 houses conventional engine and drive components for moving the paving machine 30 over the surface.

Although designed to construct a concrete pavement with dowel bar and center bar insertion, the paving machine 30 may be disconnected and reassembled as a paving machine without dowel bar or center bar insertion. With reference to FIG. 3, the frame 32 may be detached at the forward crossbeam 46 and at the middle crossbeam 47. After being detached, the paving machine 30 has a front section from internal vibrators 54 forward and a rear section from the tamping bar 86 rearward. The front section and the rear section may be connected together to form the paving machine without dowel bar or center bar insertion.

Dowel Bar Feeder

Figure 4:
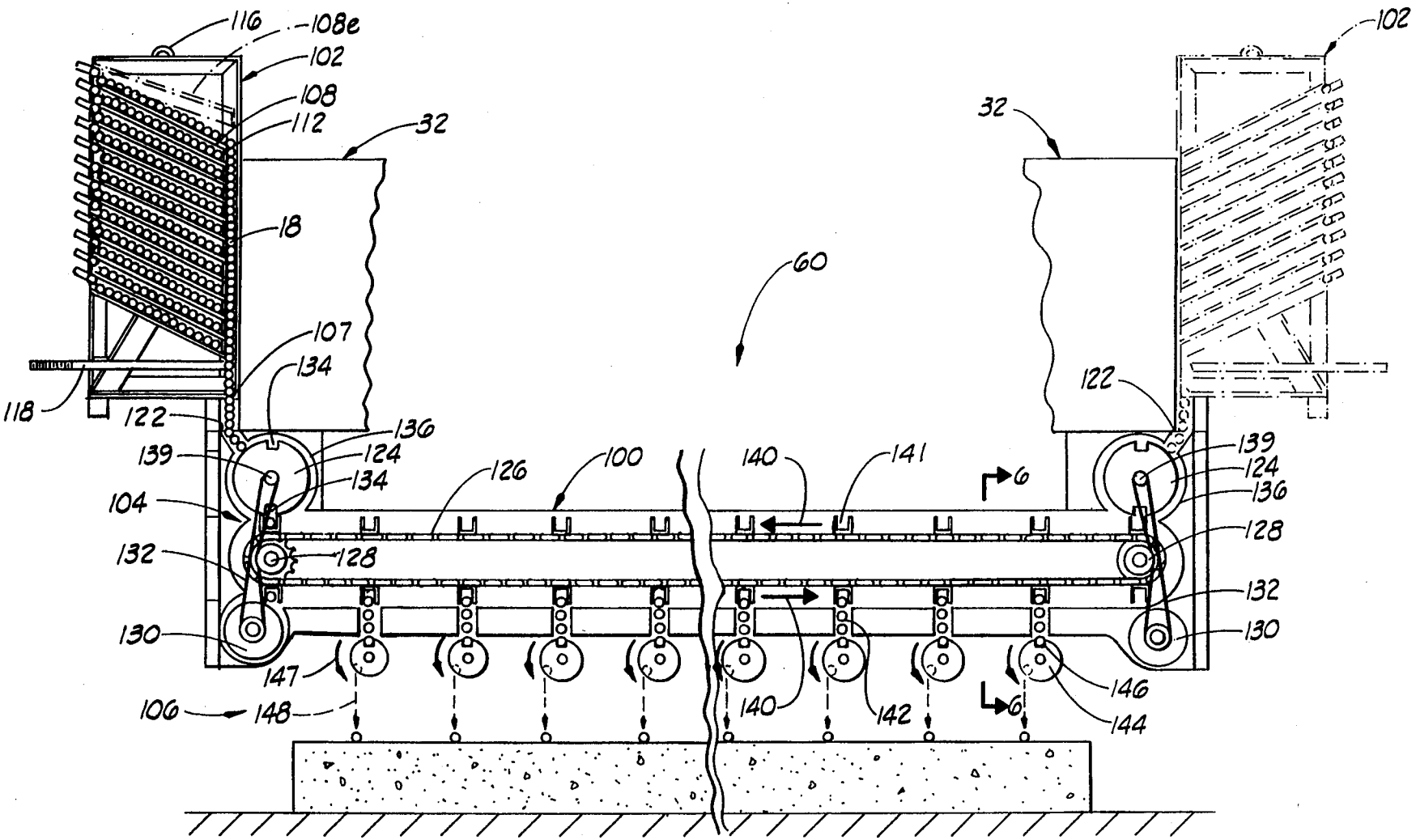
FIG. 4 is a diagrammatical front view of a portion of the dowel bar feeder of the paving machine taken along lines 4—4 of FIG. 3.

Turning now to FIG. 4, the structure of the dowel bar feeder 60 is described in detail. The dowel bar feeder 60 includes a feeder housing 100, a feeder magazine 102, a bar transfer assembly 104 and a bar drop assembly 106.

The feeder magazine 102 is removably attached to the frame 32 of the machine 30 above one end of the feeder housing 100. The bottom of the magazine 102 has an exit slot 107 through which the dowel bars 18 move from the magazine 102 into the feeder housing 100.

A series of trays are pivotally mounted within the feeder magazine 102. One of the trays is designated by reference number 108 and is generally representative of the magazine trays. The trays 108 are pivotally mounted within the feeder magazine 102 toward the side of the feeder magazine 102 opposite the frame 32. The trays 108 extend angularly downward toward the frame side of the feeder magazine 102.

Each tray 108 is sized and shaped to accommodate a plurality of dowel bars 18. The end of each tray 108 toward the frame 32 has a lip 110 which extends downward to prevent the release of dowel bars 18 from the tray 108 immediately below. The end of each tray 108 opposite the frame 32 should be counterweighted or spring-biased to cause the tray 108 to tip up at the end toward the frame 32 when the last dowel bar 18 leaves the tray 108.

As the empty tray 108*e* (shown in phantom) pivots, the lip 110 of the empty tray 108*e* moves upward to release the dowel bars 18 of the tray 108 immediately below the empty tray 108*e*). The dowel bars 18 in the feeder magazine 102, therefore, are supplied from one tray at a time, proceeding from the top tray 108 to the bottom tray 108, until the supply of dowel bars 18 in the feeder magazine 102 is depleted.

Once all the dowel bars are emptied from the feeder magazine 102, the empty feeder magazine 102 is removed from the frame 32. A magazine 102 loaded with dowel bars is then hoisted up to and secured to the frame 32. A lifting eye 116 is provided on the outside of each feeder magazine 102 and a hoist (not shown) is mounted on the frame of the machine 30 to lower empty feeder magazines and lift loaded feeder magazines 102 into the installed position.

A plurality of magazines 102 loaded with dowel bars 18 may be set out alongside the path of the pavement to be built at intervals where additional supplies of dowel bars 18 will be required. In this way, the operation of the paving machine 30 is not interrupted by running out of dowel bars 18.

Continuing to refer to FIG. 4, a release handle 118 is attached to each feeder magazine 102. The release handle 118 extends across the lower end of the feeder magazine 102 and is adapted to be in a "locked" position and a "release" position. In the "locked" position, the release handle 118 obstructs the exit slot 107 of the feeder magazine 102 and prevents the dowel bars 18 from dropping through the exit slot 107. The release handle 118 is in the "locked" position while loading the feeder magazine 102 and until the feeder magazine 102 is installed upon the frame 32 of the paving machine 30.

In the "release" position, the release handle 118 is withdrawn from the exit slot 107 of the feeder magazine 102 to allow dowel bars 18 to be fed from the feeder magazine 102. The release handle 118 is moved to the "release" position after the feeder magazine 102 is mounted in place to the frame 32 for dispensing dowel bars 18.

The bar transfer assembly 104 of the feeder 60 is mounted within the feeder housing 100. The feeder housing 100 encloses the bar transfer assembly 104 except for a transfer slot 122 at each end of the feeder housing 100 to communicate with the exit slot 107 of the magazine 102 to receive dowel bars 18 one at a time from the magazine 102.

Continuing to refer to FIG. 4, the bar transfer assembly 104 comprises a pair of shaft-mounted transfer disks 124, a pair of parallel chain loops 126, two pairs of chain loop sprockets 128, a drive sprocket 130 and a timing chain 132. The drive sprocket 130 is powered by a motor (not shown) to rotate the transfer disks 124 and the chain loops 126 with synchronization provided by the timing chain 132.

Each transfer disk 124 has a pair of cutouts 134 which are aligned and shaped to receive one of the dowel bars 18. When a set of the cutouts 134 lines up with the transfer slot 122 as the transfer disks 124 rotate, a dowel bar 18 gravity feeds into the cutouts 134. As shown in FIG. 4, the position of the cutouts 134 for the transfer of a dowel bar 18 from the magazine 102 to the transfer disks 124 is between the ten and eleven o'clock positions.

As shown in FIG. 4, the cutouts 134 holding the dowel bar 18 rotate clockwise to the six o'clock position, where the dowel bar 18 gravity feeds to the chain loops 126. A cylindrical cover 136 surrounds the transfer disks 124 except at the transfer area from the magazine 102 and the transfer area to the chain loops 126. The cover 136 is necessary between the ten to eleven o'clock dowel bar receiving position and the six o'clock dowel bar discharge position of the cutouts 134 to retain the dowel bar 18 within the cutouts 134 of the transfer disks 124.

The timing chain 132 is mounted upon the drive sprocket 130, the chain loop sprockets 128 and a transfer disks sprocket 139 to provide synchronized rotation of the transfer disks 124 and the chain loops 126. The movement of the chain loops 126 is indicated by direction arrows 140.

A plurality of U-shaped pockets are secured to the outside of the chain loops 126. One of these pockets is designated by reference numeral 141 and is generally representative of the pockets attached to the chain loops 126. The base of each pocket 141 is attached to the chain loop 126 and the legs of each pocket 141 extend toward the interior wall of the housing 100. The U-shape of each pocket 141 is sized to accommodate the diameter of one dowel bar 18.

In addition, each pocket 141 of one chain loop 126 is aligned with one pocket 141 of the other chain loop 126 to form a rotating pair of pockets 141 which cooperate to receive one dowel bar 18. When disposed in one of the pairs of rotating pockets 141, a dowel bar 18 is trapped within the pockets 141 for travel with the rotation of the chain loops 126.

With continued reference to FIG. 4, the dowel bar drop mechanism 106 is located across the underside of the feeder 60. The dowel bar drop mechanism 106 includes a plurality of drop slots through the lower wall of the feeder housing 100. One of the drop slots is designated by reference numeral 142 and is generally representative of the feeder drop slots. Each drop slot 142 should be wide enough and long enough to allow a dowel bar 18 to pass through the drop slot 142 by gravity. The height of each drop slot 142 is typically about twice the diameter of one of the dowel bars 18.

Mounted beneath each drop slot 142 is a pair of shaft-mounted drop disks. One of the drop disks is designated by reference numeral 144 and is generally representative of the feeder drop disks. Each drop disk 144 has a cutout 146 shaped to accommodate the diameter of one of the dowel bars 18.

The cutouts 146 of each pair of drop disks 144 are aligned and rotate between a receiving position at about twelve o'clock and a drop position at about eight o'clock. The rotation of the drop disks 144 is illustrated by direction arrow 147 in FIG. 4.

When the cutouts 146 of the drop disks 144 are at twelve o'clock, a dowel bar 18 falls from the drop slot 142 into the cutouts 146. When the cutouts 146 of the drop disks 144 reach approximately eight o'clock, the dowel bar 18 falls from the cutouts 146 onto the concrete 42. The dropping of the dowel bars is indicated by direction arrow 148 in FIG. 4.

It should be appreciated that the spacing of the chain loop pockets 141, the drop slots 142 and the drop disks 144 corresponds to the desired spacing between the dowel bars 18 across the concrete. Moreover, the dimensions of the transfer disks 124, the chain loop sprockets 128 and the transfer disk sprockets 139 are such that the cutouts 134 of the transfer disks 124 align with the pockets 141 of the chain loops 126 as the transfer disks 124 and chain loops 126 rotate.

An important feature of the feeder 60 is that four dowel bars 18 are positioned to be dropped at almost all times. At each drop position, one dowel bar 18 is in the pockets 141 of the chain loops 126, two dowel bars 18 are in the drop slot 142 of the feeder 60, and one dowel bar is cradled in the cutouts 146 of the drop disks 144 ready for immediate dropping.

By having four dowel bars staged for dropping, ample time is provided for removing an empty magazine 102, installing a full magazine 102 and running the feeder 60 until four dowel bars 18 are staged at each drop point. It should be appreciated that the feeder 60 only runs when it is necessary to replenish the four-deep staging of dowel bars 18.

As shown in FIG. 4, the magazine 102 extends laterally from the frame 32 of the machine 30. Unfortunately, a permanent obstruction may be in the path of the protruding magazine 102 as the machine 30 travels along to build the road. To solve this problem, the magazine 102 may supply dowel bars 18 to the chain loops 126 from either side of the machine 30.

As indicated by broken lines in FIG. 4, magazines 102 may be mounted on the right side as well as the left side of the frame 32 of the machine 30. Although the transfer of the dowel bars 18 from the magazine 102 to the chain loops 126 may take place at either end of the feeder 60, the operation of the feeder 60 is similar in either case.

Figure 5:
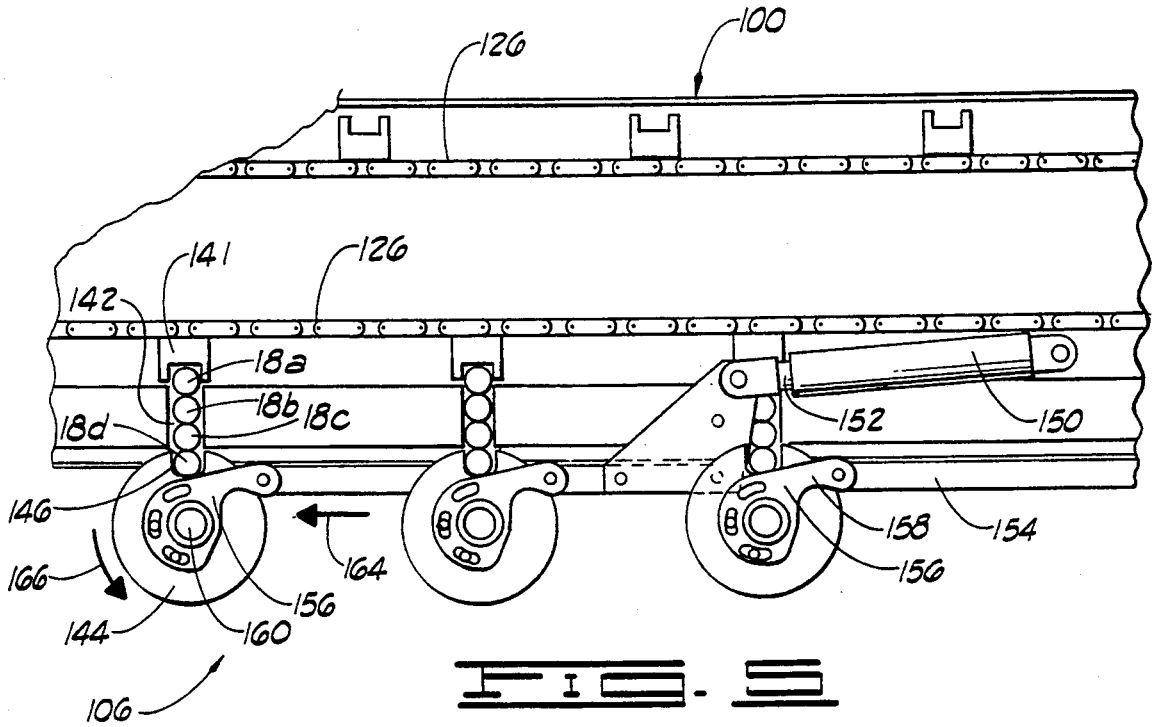
FIG. 5 is a partly diagrammatical front view of a portion of the dowel bar feeder illustrating the mechanism for dropping dowel bars in a straight pattern.
Figure 5:
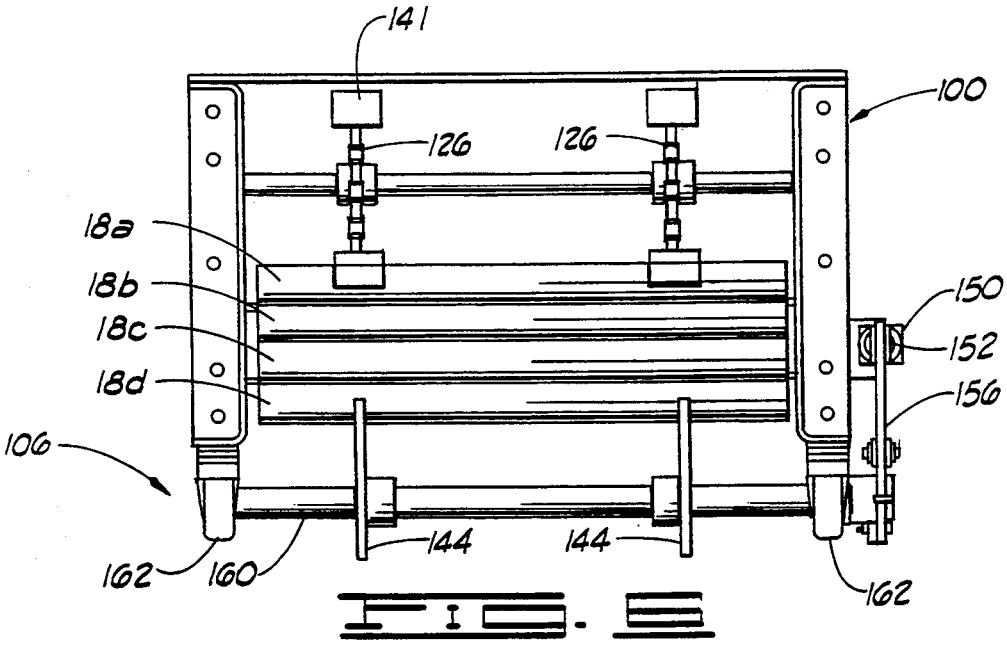

Turning now to FIGS. 5 and 6, the dowel bar drop assembly 106 is described in detail. For the straight dowel bar pattern illustrated by FIG. 1, all of the dowel bars 18 for a transverse joint 12 may be dropped at one time. Accordingly, one hydraulic drop cylinder 150 may employed to rotate all the drop disks 144 at once.

The drop cylinder 150 is typically mounted to a medial portion of the feeder housing 100 in a substantially horizontal position. The piston 152 of the cylinder 150 is secured to a linkage assembly which rotates all the drop disks 144 at once in response to the extension or retraction of the piston 152. The linkage includes a traveling bar 154 and a plurality of drop cams 156, each drop cam 156 corresponding to one of the drop positions of the feeder 60. Each drop cam 156 has an arm 158 which is pivotally attached to the traveling bar 154 and each drop cam 156 rotates in response to the movement of the traveling bar 154 by the piston 152 of the drop cylinder 150.

With reference now to FIG. 6, each drop cam 156 is secured to a drop shaft 160 upon which the corresponding drop disks 144 are mounted by keys and set screws. A pair of pillow blocks 162 are attached to the feeder housing 100 and the drop shaft 160 is journaled through the pillow blocks 162 for rotation.

An example of the bar drop operation is illustrated by FIG. 5. Four dowel bars 18*a*, 18*b*, 18*c* and 18*d* are staged to be dropped. The bottom dowel bar 18*d* is cradled by the cutouts 146 of the drop disks 144. When the piston 152 of the cylinder 150 is extended, the traveling bar 154 moves as indicated by direction arrow 164. The drop cam 156 rotates in response to the movement of the traveling bar 154 and turns the drop shaft 160 in the counterclockwise direction 166. The drop disks 144 turn with the drop shaft 160 until the cutouts 146 reach the drop position and the dowel bar 18*d* falls from the cutouts 146 of the drop disks 144.

Retraction of the piston 152 returns the cutouts 146 to the twelve o'clock position and the next dowel bar 18*c* drops into the cutouts 146 of the drop disks 144. The feeder 60 is then ready for the next dowel bar drop well in advance of the next transverse joint location.

Dowel Bar Inserter

Figure 7:
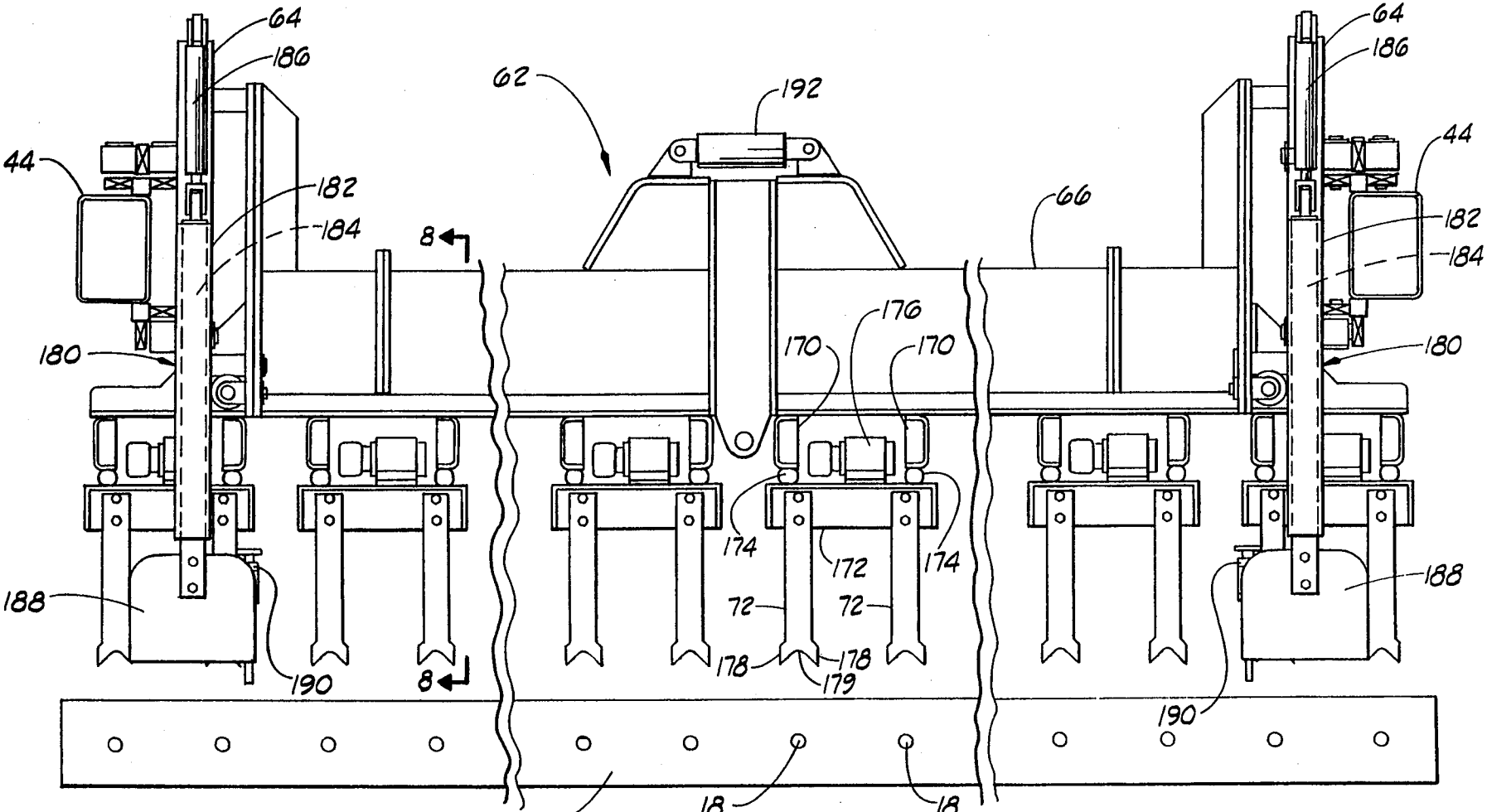
FIG. 7 is a view of a portion of the dowel bar inserter taken along lines 7—7 of FIG. 3.

With reference now to FIG. 7, the construction of the dowel bar inserter 62 is described in detail. The inserter 62 extends across the width of the machine 30 above the surface to be paved. For insertion of the dowel bars in the straight pattern, the inserter 62 is substantially perpendicular to the direction of the pavement.

The inserter carriage 64, carrying the fork rack 66, is adapted for horizontal movement while the fork rack 66 is constructed to move vertically within the inserter carriage 64. The forks 72 are mounted to the fork rack 66 with a pair of mounting brackets 170 and a mounting frame 172. Each mounting bracket 170 is secured to the underside of the fork rack 66 and the mounting frame 172, in turn, is attached to the respective mounting brackets 170.

Elastomeric disks 174 are positioned between the mounting brackets 170 and the mounting frame 172 at each point of attachment to isolate the vibration of the mounting frame 172 from the rest of the machine 30. Typically the mounting frame 172 is substantially rectangular in shape and the elastomeric disks 174 are positioned at the four corners of the mounting frame 172.

A vibrating motor 176 is centrally mounted upon the mounting frame 172 to provide vibration to the forks 72 attached to the mounting frame 172. Typically two sets of forks 72 are secured to each mounting frame 172. When designed to insert an odd number of dowel bars 18, however, one mounting frame 172 will necessarily have an odd number of fork sets.

Each fork 72 is an elongated plate with an upper end attached to its respective mounting frame 172 and a lower end extending downward toward the concrete 42. The lower end of each fork 72 has a pair of prongs 178 with a recess 179 between the prongs 178. As the forks 72 descend into the concrete 42, each dowel bar 18 is forced into the recesses 179 between the prongs 178 of its respective forks 72 and is inserted into the concrete 42.

With continued reference to FIG. 7, a spade assembly 180 is vertically mounted to each end of the inserter carriage 64 to the rear of the fork rack 66. Each spade assembly 180 includes a tubular spade guide column 182, a spade bar 184 telescoping from the spade guide column 182, a spade hydraulic cylinder 186 and a spade 188.

Each spade 188 is typically an 8-inch by 12-inch plate attached to the lower end of the spade bar 184. Each spade guide column 182 is attached to the inserter carriage 64 in a vertical position. Each spade cylinder 186 is secured to the inserter carriage 64 in position for the piston of the cylinder 186 to extend into the spade guide column 182. The piston of the each spade cylinder 186 is attached to the upper end of the respective spade bar 184.

By extending the pistons of the spade cylinders 186, the spades 188 are pushed into the concrete 42 as the spade bars 184 telescope out of their corresponding spade guide columns 182. Conversely, the retraction of the pistons of the spade cylinders 186 withdraws the spades 188 from the concrete 42.

Adjustable down stops 190 equipped with limit switches are provided at each end of the inserter carriage 64 to control the depth of insertion of the forks 72 and the spades 188 into the concrete 42. The down stops 190 are screwed up or down to set how far the forks 72 and the spades 188 are inserted into the concrete 42.

It is often desirable or required to build a pavement with a crown in the center to cause water to drain off to the sides of the pavement. If the lower ends of the forks 72 defined a horizontal plane, the dowel bars would not be inserted to a uniform depth in a crowned pavement. The dowel bars 18 in the middle of the road would be inserted deeper into the concrete 42 than the outer dowel bars 18 because of the crown in the road.

In order to provide for proper depth of dowel bar insertion into a crowned pavement, the inserter carriage 64 is constructed to pivot in the middle and a crown cylinder 194 is mounted atop the inserter carriage 64 across the two sections of the inserter carriage 64. The crown cylinder 194 may be extended to cause the outer forks 72 to extend further downward than the inner forks 72.

By adjusting the crown cylinder 194, the lower ends of the forks 72 may be set to parallel the slope of the crowned pavement. In this manner, the dowel bars 18 may be inserted a uniform depth into the concrete 42 when a crown is being formed in the center of the pavement.

Figure 8:
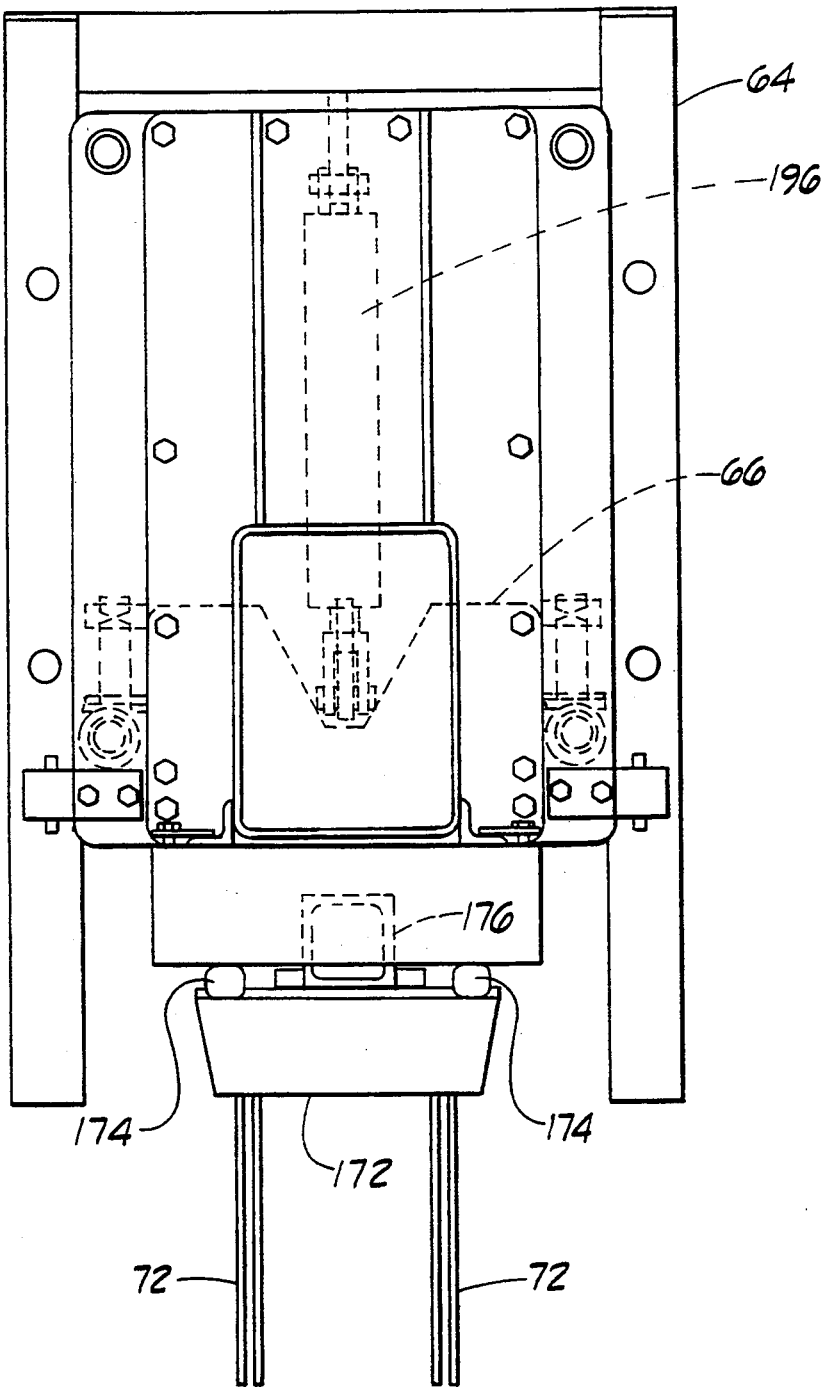
FIG. 8 is a side view of the fork rack of the dowel bar inserter taken along the lines 8—8 of FIG. 7.

Turning now to FIG. 8, a vertical cylinder 196 is provided at each end of the fork rack 66 to move the fork rack 66 up and down within the inserter carriage 64. Each vertical cylinder 196 is attached to the inserter carriage 64 and to the fork rack 66.

The forks 72 are mounted to the lower mounting frame 172 in sets of four. Each set of forks 72 corresponds to one dowel bar position. The two front forks 72 engage a forward portion the dowel bar 18 and the two rear forks contact a rear portion of the dowel bar 18 to push the dowel bar 18 down into the concrete. By providing front and back forks 72 in pairs, the inserter 62 can continue to operate if one of the front or back forks 72 happens to break.

Control and Operation

Conventional control systems are utilized to guide and operate the machine except for the operation and control of the dowel bar feeder and inserter. A detailed description of the system used to control and operate the dowel bar feeder and inserter of the machine is contained within the following discussion.

It should be apparent that accurate interval spacings and synchronization of the feeder 60 with the inserter 62 is essential to proper operation of the machine 30. In order to coordinate the operations of the machine 30, a programmable logic controller is provided.

An acceptable programmable logic controller is the model TSX 17-20 with 40 Input/Outputs, catalog no. TSX-172-4012E, including the discrete I/O extension, catalog no. TSX-DMF-401, by Telemecanique. For the sake of brevity, the programmable logic controller is indicated by the abbreviation "PLC" and the discrete I/O extension is designated as "DMF." Moreover, the dowel bar inserter is referred to as "DBI" in the circuit drawings of the PLC and the DMF.

The PLC includes 32 timers, 15 counters, shift registers, 8 step counters and 1 fast counter/time, all of which are available for the control and operation of the machine 30. The use of various timers and counters is described in the following discussion.

Referring now to FIG. 9, PLC outputs 0 through 7, 10, 12 and 15 are used to control the major functions of the dowel bar feeder 60 and inserter 62. PLC output 0 is connected to PLC relay R28 to control the power supplied to the feeder 60 and inserter 62. PLC output 1 and PLC relay R10 operate the running of the feeder 60.

PLC output 2 is connected to PLC relay R24 to release the inserter carriage 64 for movement to the rear. PLC output 3 is connected to PLC relay R23 to return the inserter carriage 64 to the forward position. PLC outputs 4 and 5 are connected to PLC relays R26 and R25, respectively, to move the fork rack 66 down and up. PLC output 6 and PLC relay R27 function to turn the fork vibrators 176 on and off. PLC output 7 is connected to PLC relay R22 to move the spades 188 up and down.

PLC output 10 and PLC relay R21 cooperate to control the spacing between the transverse joints to be formed in the pavement. A circuit using PLC output 12 and PLC relay R20 is provided to deliver a timed 24 VDC pulse when the inserter is in its full down position. This pulse may be used to actuate devices that mark the grade or slab side at the centerline of the transverse joint. These marks can be used later as references for sawing the transverse joints in the concrete slab.

Figure 10:
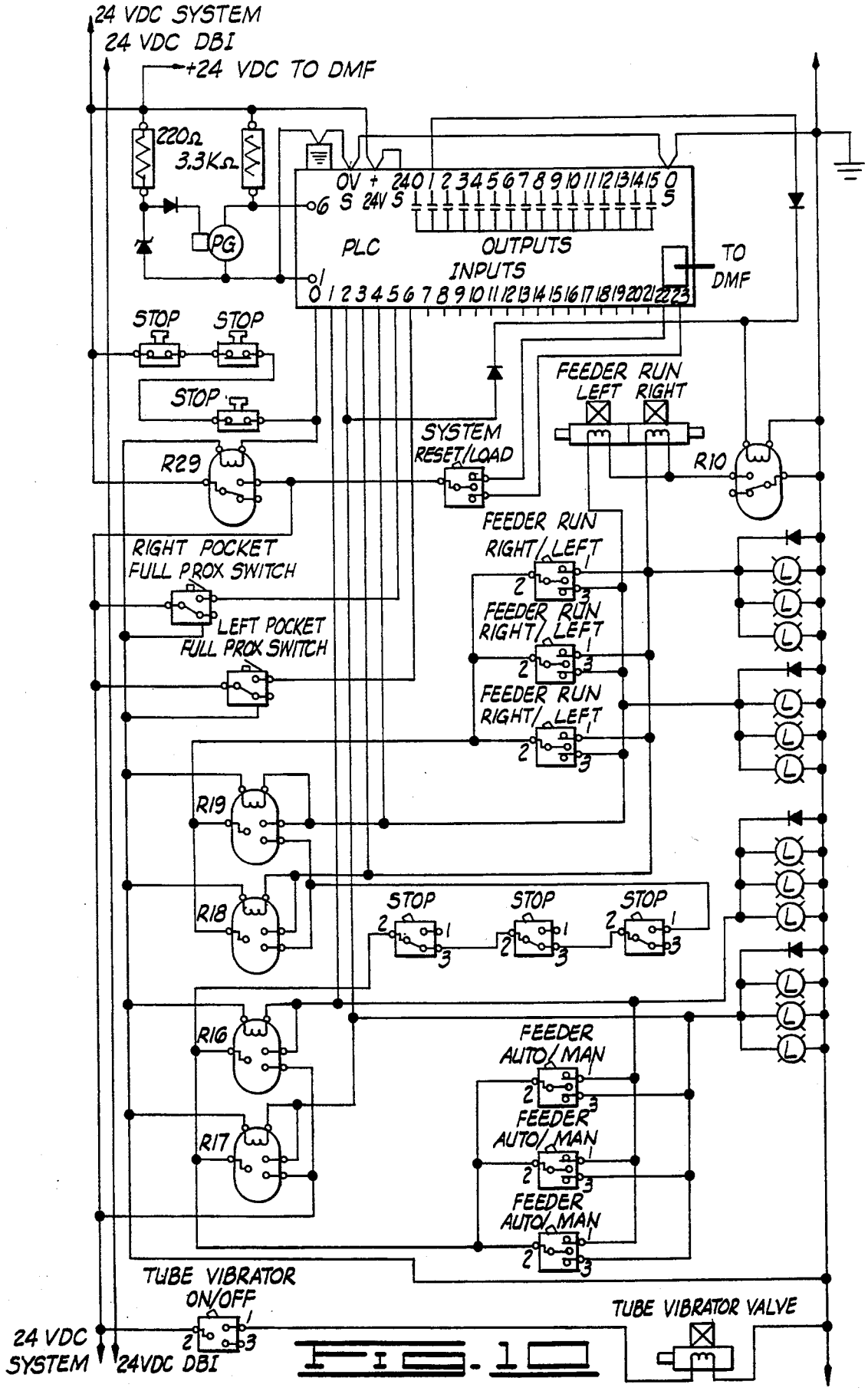
FIG. 10 is a logic diagram of the dowel bar feeder run portion of the programmable logic controller.

Turning now to FIG. 10, the logic associated with PLC relay R10 and the feeder run function are described. The feeder run logic ladder includes feeder run switches and relays R10, R18 and R19 for running the feeder 60 from the left side or the right side. It should be appreciated that, when running from the left, the right pocket is checked to see if it is full. Similarly, in the right side mode, the left pocket is checked. In other words, the pocket farthest from the feed side is checked to see if it contains a dowel bar. If the far pocket is empty, then the feeder 60 runs until a dowel bar 18 is placed in the far pocket.

A tube vibrator on/off switch and tube vibrator valve for operating the surface tube vibrator 84 are also shown FIG. 10. The tube vibrator on/off switch is operated manually.

Figure 11:
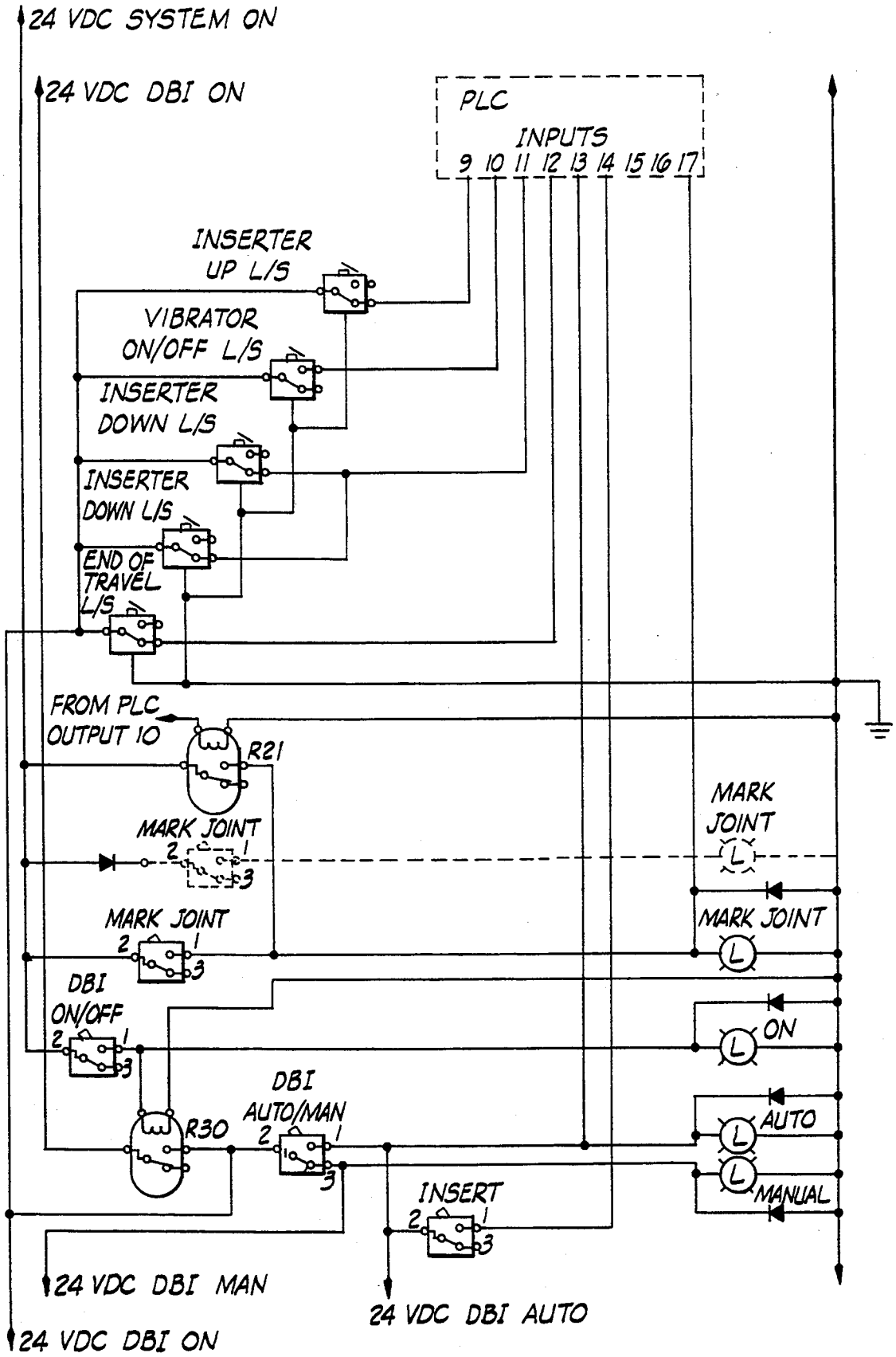
FIG. 11 is a logic diagram of the mark joint portion of the programmable logic controller.

Turning now to FIG. 11, switch inputs to the PLC include limit switch indications for the inserter 62 in the up position, for the inserter 62 in the down position, for the on/off status of the fork vibrators 176, and for the end of travel. The end of travel limit switch is tripped when the inserter carriage 64 has not returned to the forward position by the time the machine 30 has moved as far as the normal carriage travel.

Marking the locations of transverse joints may be done manually or automatically. The automatic sequence, when selected by the DBI Auto/Man switch, begins when the mark joint switch is closed momentarily or when PLC relay R21 picks up. PLC relay R21 will only pick up if the auto joint spacing is selected (input switch 22 on the DMF is "on"). Even with auto joint spacing, the mark joint switch must be closed momentarily at the first desired transverse joint position.

When the PLC receives the mark joint signal, either relay R1 is energized by PLC output 15 causing all the dowel bars to be dropped on the new concrete in the straight pattern (FIG. 12) or DMF input switch 0 is turned on to initiate the skewed pattern control (FIGS. 13 through 16). In either case, a counter is started to count off the distance from the center line of the bar rack to the center line of the forks. When this distance has been traversed or the insert switch (FIG. 11) is toggled manually, PLC outputs 2, 4 and 7 are turned on.

Figure 12:
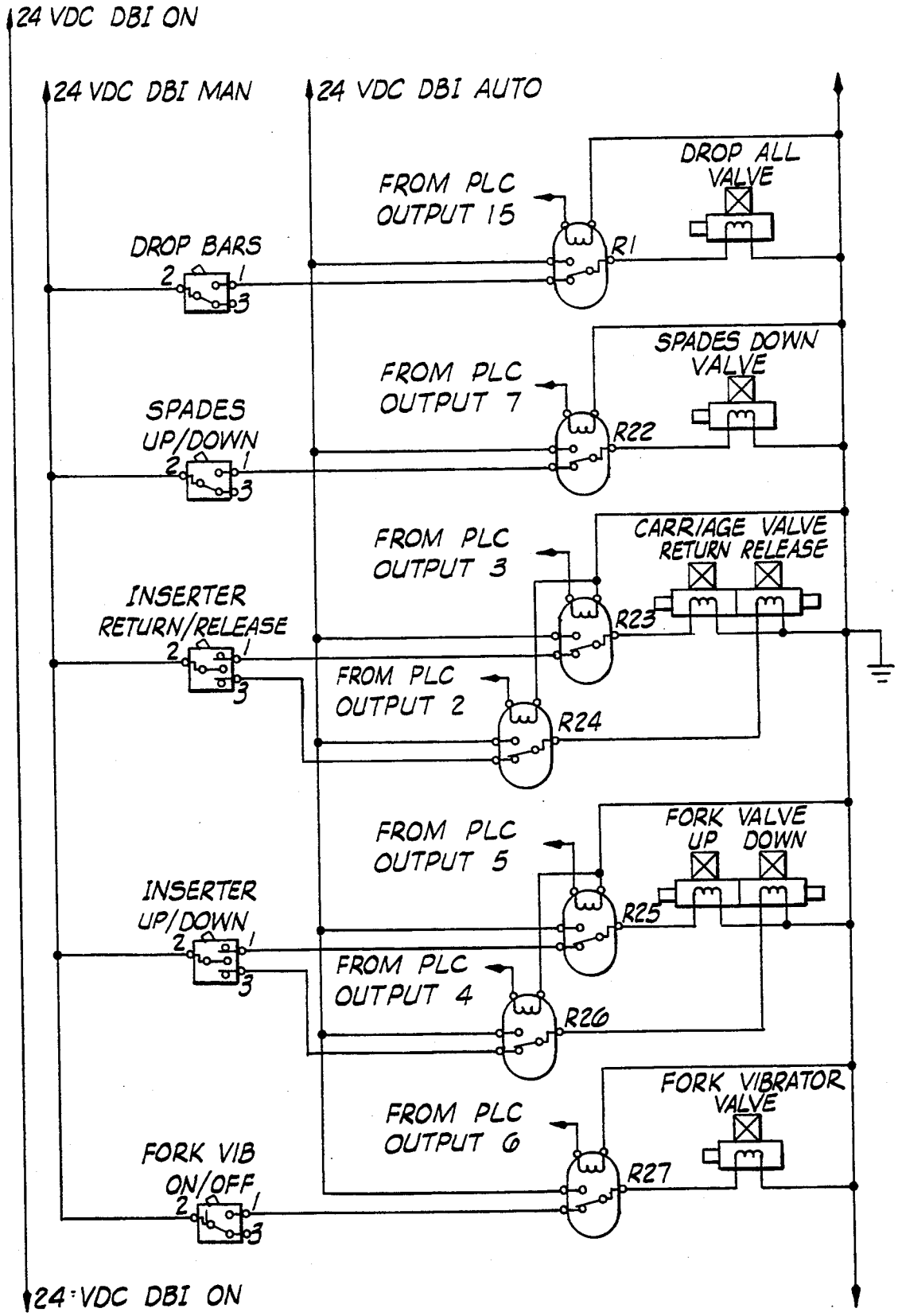
FIG. 12 is a logic diagram of the drop dowel bars and dowel bar inserter portion of the programmable logic controller.
Figure 13:
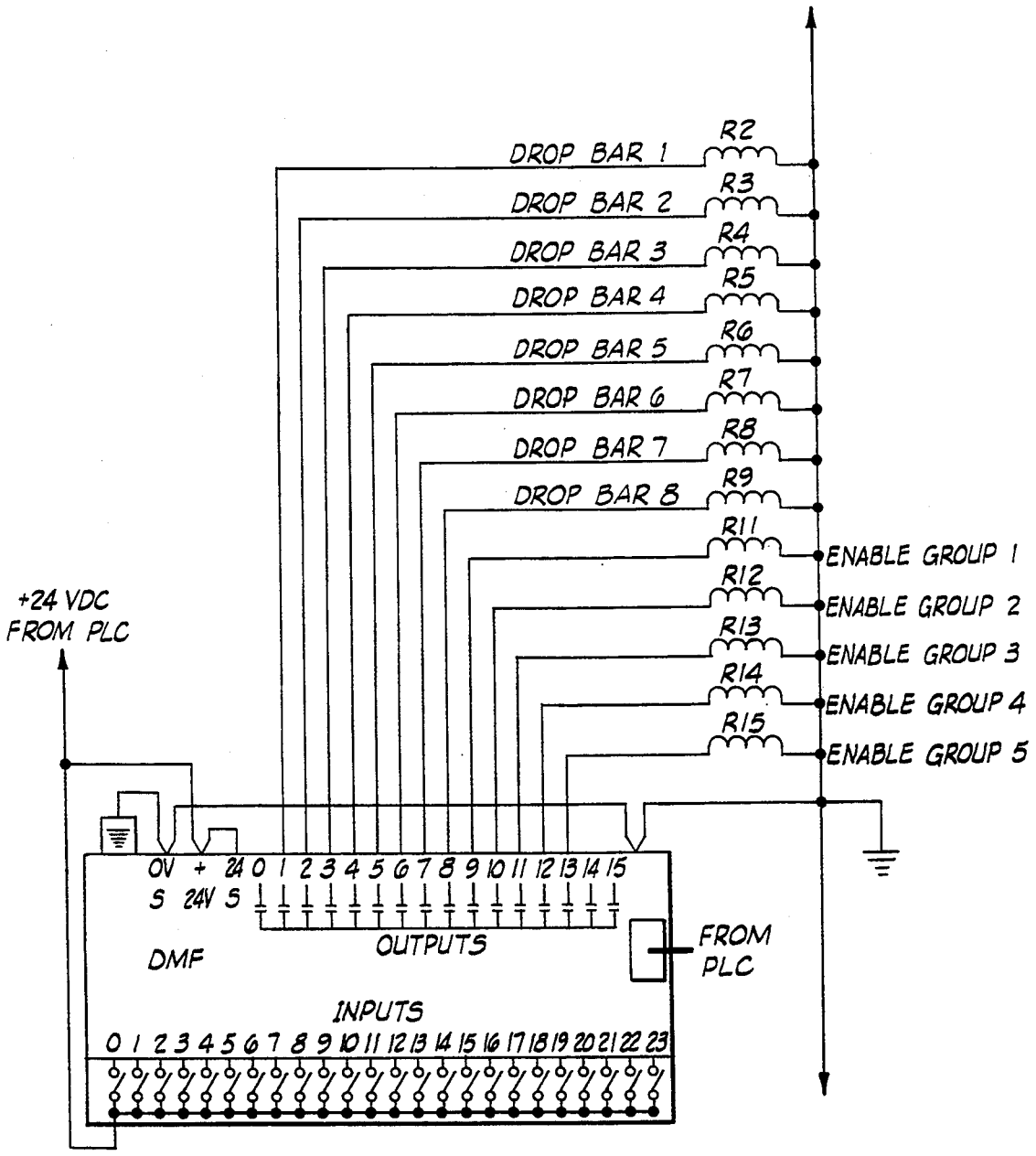
FIG. 13 is a logic diagram of the outputs of the discrete I/O extension to the programmable logic controller.

With reference now to FIG. 12, output 2 energizes relay R24 which energizes the carriage release valve. The carriage release valve allows hydraulic oil to flow freely and out of the inserter carriage return cylinder 68. This allows the inserter carriage 64 containing the forks 72 to remain stationary while the rest of the paving machine 30 moves forward. Output 4 energizes PLC relay R26 which in turn energizes the fork down valve to cause the forks 72 to travel downward. Output 7 energizes PLC relay R22 which energizes the spades down valve. This causes the spades 188 to be driven into the concrete 42 to prevent the inserter carriage 64 from moving.

As the forks proceed down, a metal plate passes the vibrator on/off L/S (proximity switch). This causes PLC output 6 to turn on PLC relay R27 which energizes the fork vibrator valve causing the vibrator motors 176 to start vibrating the forks 72.

The fork down valve remains energized until both fork down L/S's (proximity switches) are tripped. Tripping both of these switches causes PLC output 4 to de-energize to stop the forks 72 from descending any farther. PLC timer T2 is started when both fork down switches are tripped. Timer T2 determines the amount of time the vibrating forks 72 are allowed to stay in the concrete to help consolidate the concrete around the dowel bars 18. When T2 times out, PLC output 5 is turned on to energize PLC relay R25 which operates the fork up valve causing the forks 72 to begin upward travel.

As the forks 72 proceed up, a metal plate passes the vibrator on/off L/S (proximity switch). This turns off PLC output 6 to de-energize the fork vibrator valve. The forks continue to ascend until the forks up L/S (proximity switch) is tripped. Tripping the forks up switch causes PLC output 5 to turn off to stop the upward movement of the forks 72. PLC outputs 2 and 7 are turned off at the same time as PLC output 6. Turning off PLC output 2 de-energizes the carriage release valve and turning off PLC output 7 causes the spades 188 to be pulled up.

After a short time delay controlled by PLC timer T6, PLC output 3 is turned on energizing relay R23 to energize the carriage return valve. This causes the inserter carriage 64 to be pulled to its forwardmost position. PLC output 3 remains on for a time period controlled by timer T3 in the PLC.

If the inserter carriage 64 does not return before the paving machine 30 has moved as far as normal carriage travel, the end of travel L/S (proximity switch) is tripped. This causes PLC output 0 to turn off, de-energizing relay R28 and causing the paving machine to stop until the inserter carriage 64 completes its movement forward.

Auto Joint Spacing

By setting input switch 22 on the DMF to the "on" position the PLC will automatically measure the distance between transverse joints and generate a "mark joint" contact closure. Relay R22 is energized by PLC output 10 to provide this signal after the mark joint switch has been toggled once. This signal will be generated at intervals controlled by counters until the system is reset.

If DMF input switch 21 is set to the "on" position, a sequence of four joint spacings will be generated and then repeated. These spacings are controlled by counters Cl through C4. If DMF input switch 21 is turned off, counters C1 and C2 alternate to provide the joint spacing. The signal generated by R22 is also coupled to the spacing control for the center bars.

It should be noted that use of this feature may save labor, but cumulative errors may cause the distance between the first joint and the last joint in a paving run to be greater or less than anticipated.

Straight Dowel Bar Pattern

At this point, it may be helpful to refer back to FIG. 3 as the operation of the machine 30 for building a pavement 14 with a straight dowel bar pattern is described.

As the machine 30 moves forward, in the direction indicated by direction arrow 200, the screw 50 or paddle 51 proportions the concrete mix in front of the front strike-off 52. The front strike-off 52 is vertically adjusted to allow the correct amount of unconsolidated concrete to be under the frame 32 for consolidation by the internal vibrators 54.

The internal vibrators 54 then consolidate the concrete and the concrete metering screed 58 levels out the correct volume of consolidated concrete to form the finished concrete slab. This step is vital to proper insertion of dowel bars 18 by the machine 30. The consolidation by the internal vibrators 54 gives the concrete the consistency of a finished, unhardened concrete slab and the leveling by the metering screed 58 provides an even surface upon which to drop the dowel bars 18.

Once consolidated, the concrete is sufficiently dense to maintain its shape as a slab without any external support. When dropped on the consolidated concrete, therefore, a dowel bar 18 sticks on the concrete surface in the position in which it was dropped. If the concrete were not consolidated before the dowel bars 18 were dropped, the dowel bars 18 would sink into the concrete and assume various misaligned positions.

During the operation of the machine 30, dowel bars 18 are transferred from the feeder magazine 102 as necessary and stacked four to a drop position in the feeder 60. When the machine 30 has traveled the predetermined distance between transverse joints 12, the location for the next transverse joint 12 is marked and the lowermost set of dowel bars 18 is dropped to the concrete by the drop disks 144.

As the machine 30 travels in the forward direction, as indicated by arrow 200 in FIG. 3, the fork rack 66 moves over the dowel bars 18 lying on the concrete and the fork rack 66 is lowered to push the forks 72 down into the concrete. Each set of forks 72 engages its respective dowel bar 18 and pushes the dowel bar 18 into the concrete 42. As the fork rack 66 moves down, the inserter cylinders 68 are released to allow the inserter carriage 64 to travel in the rearward direction and the spades 188 are pushed into the concrete to hold the forks 72 in place at the location of the transverse joint 12. The vibrating motors 176 of the forks 72 are turned on to facilitate the insertion of the dowel bars 18 by vibration.

When the inserter carriage 64 reaches the limit set for rearward travel, the spades 188 and forks 72 are lifted out of the concrete 42. The vibrating motors 176 of the forks 72 are left on momentarily to free concrete from the forks 72 and then the fork vibrators 176 are turned off. Once the fork rack 66 reaches the up position, the inserter cylinder 68 is operated to draw the inserter carriage 64 back to the forward position in preparation for dowel bar insertion at the next transverse joint.

Center bar insertion takes place after the dowel bars are inserted. The center bar inserter 80 is manually loaded with center bars and run by an operator to insert the center bars at predetermined center bar intervals.

After insertion of the dowel bars and the center bars, the tube vibrator 84, tamping bar 86, extrusion pan 88 and float pan 90 effect a final, smooth upper surface in the concrete 42. The tube vibrator 84 consolidates an upper portion of the concrete 42 to a final consistency. It should be appreciated that the tube vibrator 84 does not extend so far into the concrete 42 that it disturbs the positions of the dowel bars 18 or center bars 16.

Skewed Dowel Bar Pattern

In another preferred embodiment, the machine 30 is modified for building the pavement 14A with dowel bars 18 arranged in the skewed pattern. It should be recalled that FIG. 2 illustrates a pavement 14A having a skewed arrangement of dowel bars 18.

In providing skewed dowel bar insertion, the bar dropping mechanism of the feeder 60 is changed, the alignment of the forks 72 of the inserter 62 is altered, and the DMF bar dropping controls of the PLC are modified. The machines for straight and skewed dowel bar insertion are designed to have as many of the same components as possible.

Figure 17:
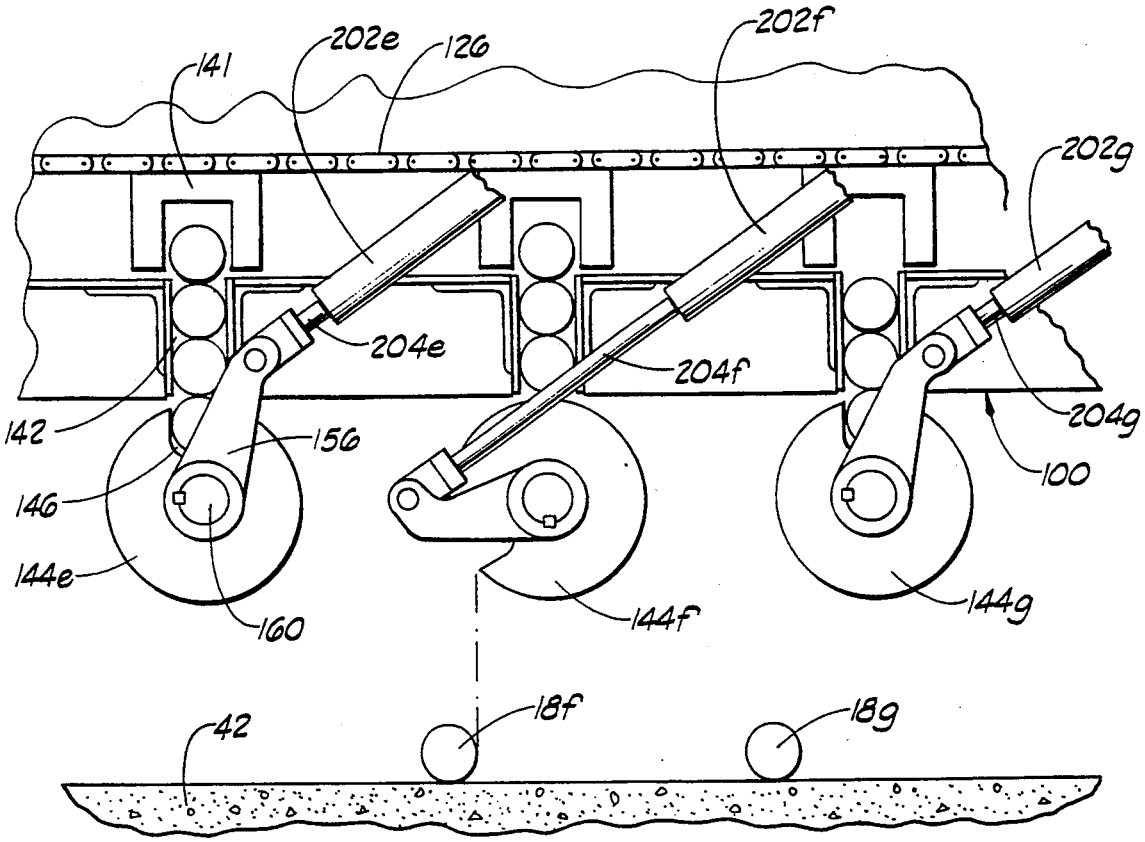
FIG. 17 is a view similar to the view of FIG. 5 but illustrating the dowel bar dropping mechanism for a skewed dowel bar pattern.

For example, the feeder 60 is different only with respect to the bar drop mechanism. As illustrated by FIG. 17, instead of the one cylinder and the linkage operating all of the drop disks at once, each set of drop disks **144*e*, 144*f* and 144*g* is equipped with its own hydraulic cylinder 202*e*, 202*f* and 202*g*, respectively. Each piston 204*e*, 204*f* and 204*g* of the corresponding cylinder 202*e*, 202*f* and 202*g* is pivotally attached to the cam 156 of the respective drop disk set 144*e*, 144*f* and 144*g***.

Continuing to refer to FIG. 17, the orientation of each cylinder **202*e*, 202*f* and 202*g* is different from the cylinder 150 of the straight pattern bar drop mechanism. For the straight pattern the piston 152 movement was substantially horizontal. In the skewed pattern, the piston 204*e*, 204*f* and 204*g*** movement is angularly downward.

Figure 18:
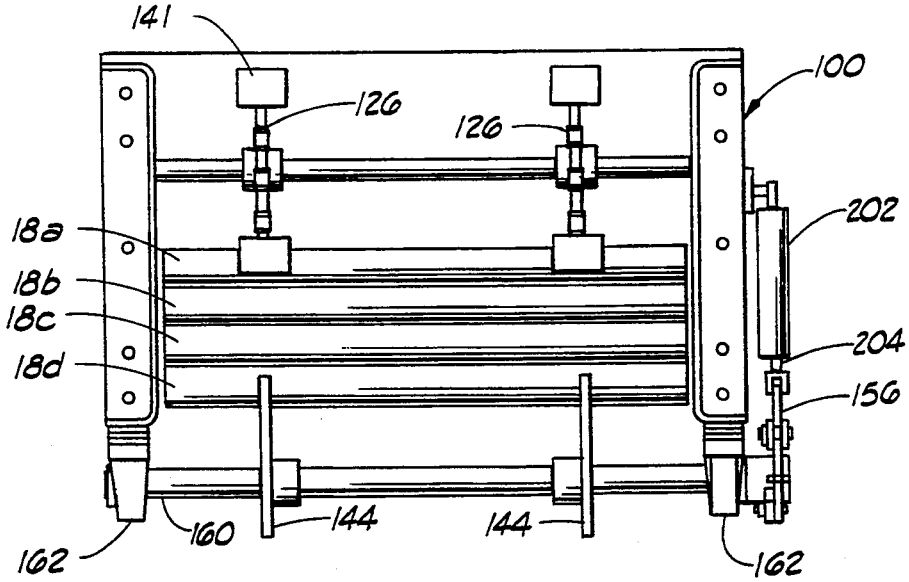
FIG. 18 is a view similar to the view of FIG. 6 but illustrating the dowel bar dropping mechanism for a skewed dowel bar pattern.
Figure 15:
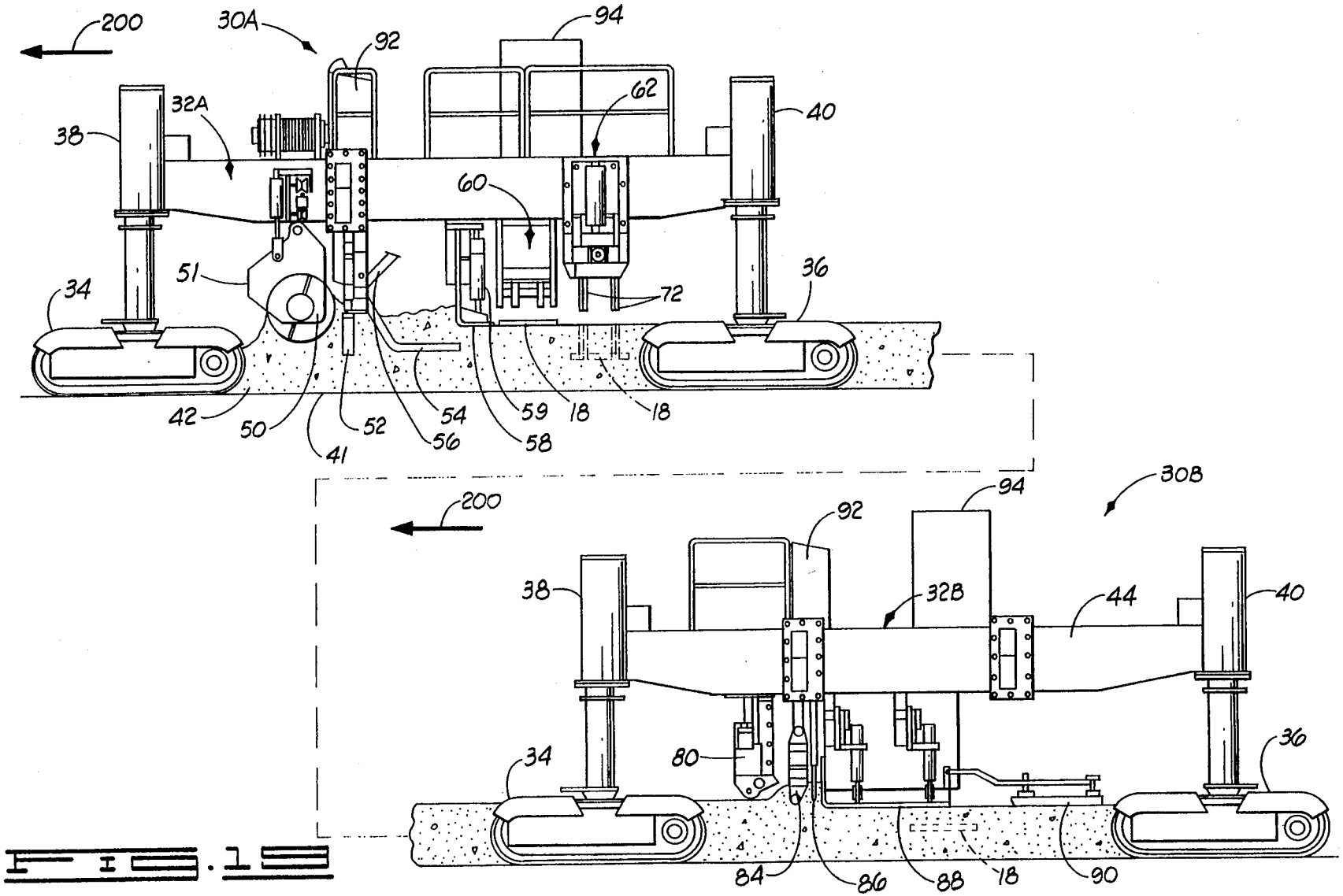

Turning now to FIG. 18, each cylinder 202 is secured to the feeder housing 100 and is connected to the cam 156 of the corresponding pair of drop disks 144. As described previously for the straight pattern, each cam 156 is connected to the drop shaft 160 which is journaled through the pair of pillow blocks 162. Each set of drop disks 144 is attached to its respective drop shaft 160 and rotates in response to the movement of its corresponding piston 204.

It should be appreciated that cylinders 202 and pistons 204 are generally representative of all the bar drop positions and that each bar drop position is equipped with its individual cylinder 202 and piston 204. This arrangement allows each set of drop disks, generally designated by reference number 144, to drop its dowel bar 18 independent from the other drop disks.

Referring back to FIG. 17, piston **204*e* has not yet extended to drop one of the staged dowel bars. Piston 204*f* has extended and dropped dowel bar 18*f*, but has not yet retracted. Therefore, another dowel bar 18 has not yet dropped into the cutout 146 of the drop disks 144*f*. In contrast, piston 204*g* has caused drop disks 144*g* to drop dowel bar 18*g* and has retracted. Note that the bottom dowel bar has dropped into the cutout 146 of drop disks 144*g* and that the pocket 141 above the drop disk 144*g*** is empty.

The individual bar drops from the feeder 60 must be made at the proper location or the forks 72 will not match up with the dowel bars 18 during the insertion process. Therefore, the coordination of the dowel bar drops is critical to proper dowel bar insertion in the skewed pattern.

The placing of the dowel bars in a skewed pattern is controlled by the PLC and the DMF. The switches on the inputs of the DMF control select the number of bars, position of first insertion (right or left) and skew on/off. The data from these switches is loaded into the PLC when the load/reset switch on the main control box is toggled momentarily to the load position and then released. When a switch is in the "on" position, the corresponding input light on the DMF will illuminate.

Setting DMF input switch 0 to the "on" position selects the skewed pattern. Setting DMF input switch 23 to the "on" position establishes that the first bar to be dropped will be on the right side. If DMF input switch 23 is off, the first bar to be dropped will be on the left side. DMF input switches 1 through 20 are used to select the number of bars to be dropped. If 20 or less bars are to be inserted, the switch with the corresponding number is set to its "on" position. If 21 to 39 bars are in the pattern, DMF input switch 20 is turned on along with one other DMF input switch. The sum of the DMF input switch numbers equals the number of bars in the pattern.

Three counters in the PLC are used to control the drop positions of the bars. Counter CO controls the distance the paving machine must travel after the mark joint signal is received. Once counter CO has counted the spacing for the first bar, counters Cl and C2 alternate counting the spacings for the rest of the bars. Two counters are used to eliminate errors caused by the necessity of rounding off the spacing to a whole number that the counter can handle. One counter is set for the rounded down value and the other counter is set for the rounded up value.

The discrete I/O extension of the PLC is programmed to coordinate the individual dowel bar drops from feeder 60. Turning back to FIG. 13, DMF outputs 1 through 8 and DMF relays R2 through R9 control the sequential drops of eight bars. Each set of eight dowel bars comprises a group.

DMF outputs 9 through 13 and relays R11 through R15 enable each group, one at a time. Accordingly, group 1 is enabled first and bars 1 through 8 are dropped one at a time. Then group 2 is enabled and bars 9 through 16 are dropped one at a time. Dropping the bars one at a time by group continues until bars have been dropped from all the drop positions of the feeder 60.

Figure 14:
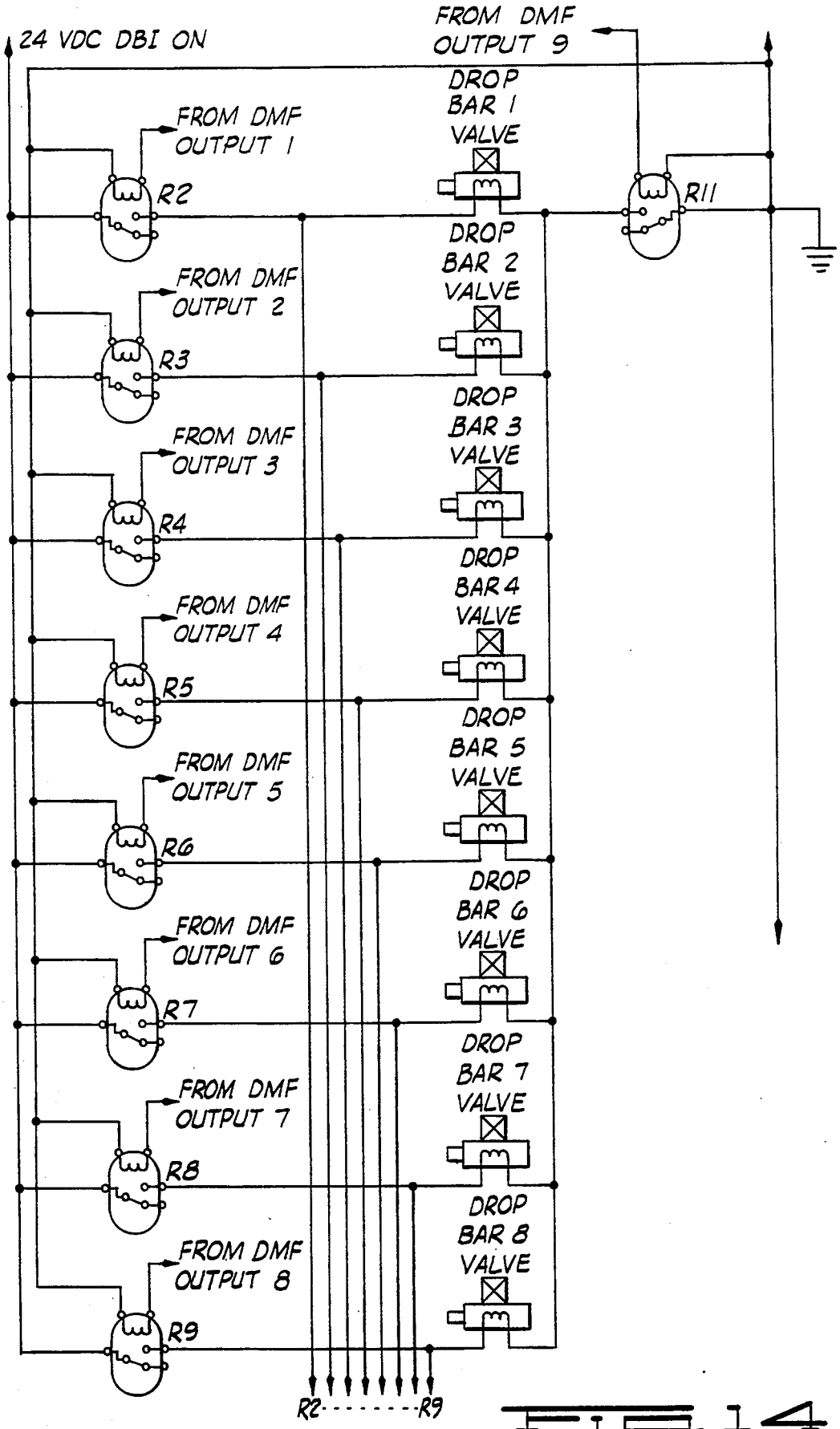
FIG. 14 is a logic diagram of the discrete I/O extension relays for dropping the first group of dowel bars one at a time.

Referring now to FIG. 14, the circuit for dropping the first group of bars is shown. The first group is enabled by relay R11 from DMF output 9. Then relays R2 through R9, in sequence, operate drop bar valves 1 through 8. Each drop bar valve 1 through 8 operates the cylinder 202 and piston 204 for drop disks 1 through 8, respectively.

Figures 15, 16:
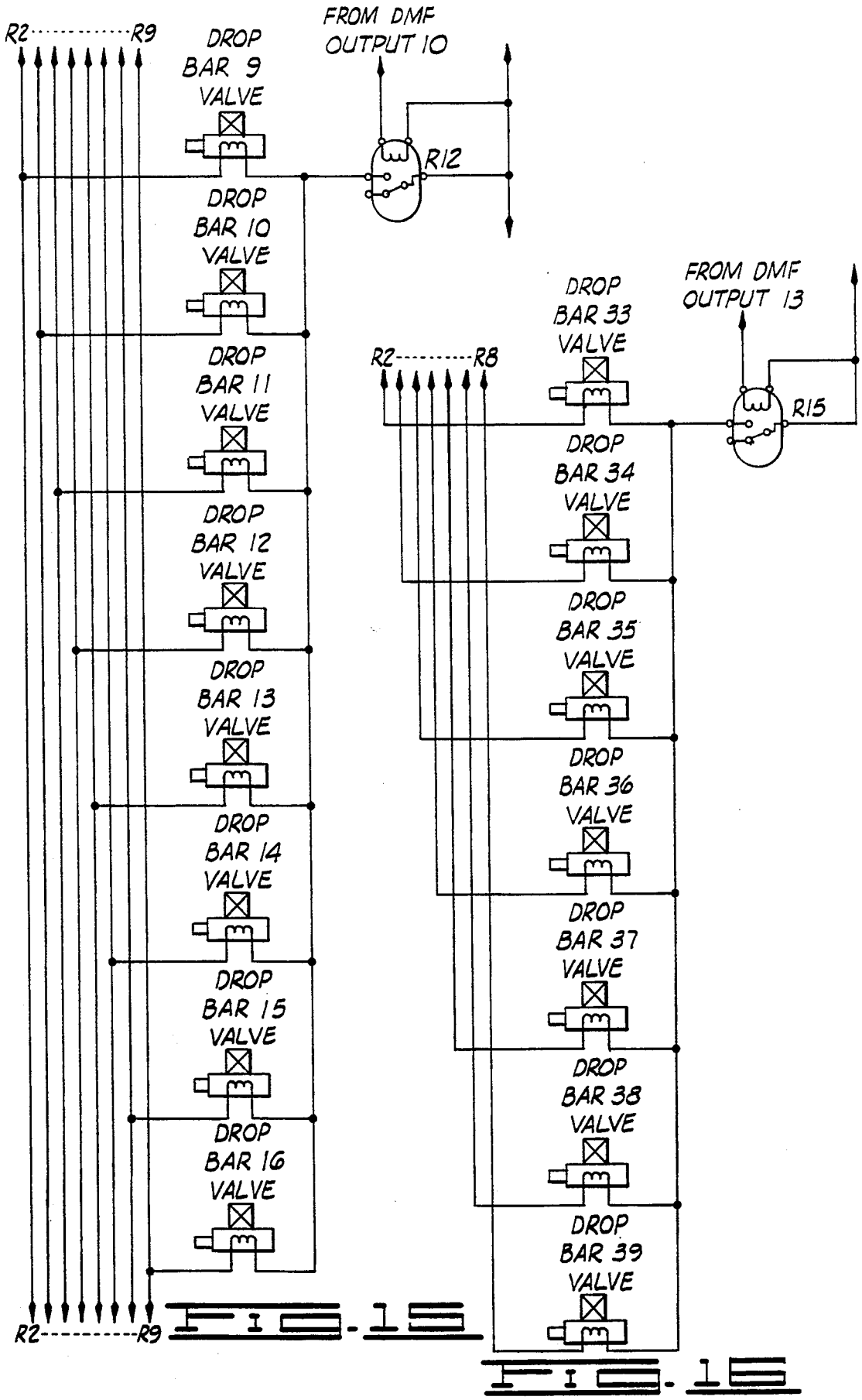
FIG. 15 is a logic diagram of the discrete I/O extension relays for dropping an intermediate group of dowel bars one at a time.
FIG. 16 is a logic diagram of the discrete I/O extension relays for dropping the final group of dowel bars one at a time.

Turning now to FIG. 15, the second group of bar drops is illustrated. The second group is enabled by relay R12 from DMF output 10. The second group is not enabled until after the first group has been enabled and all eight bars of the first group have been dropped.

As indicated in FIG. 15, the drop of bars 9 through 16 are controlled by relays R2 through R9.

It should be appreciated that groups 3 and 4 are similar to group 2. Relays R2 through R9 operate to drop eight bars after the preceding groups have been enabled and dropped.

With reference now to FIG. 16, the circuit of the last group, group 5, is described. Group 5 is enabled by relay R15 from DMF output 13. Because there are only seven bar drops in group 5, only relays R2 through R8 are used to control the bar drops. At the end of group 5, the bar drop function is complete.

The controls just described coordinate the bar drops of thirty-nine dowel bars, one at a time. To set the DMF to drop 39 dowel bars 18 in the skewed pattern, DMF input switches 0, 20 and 19 would be switched on. Having DMF input switch 0 in the "on" position selects skewed dowel bar placement. Switching DMF input switches 19 and 20 on calls for dropping 19 plus 20 dowel bars for a total of 39 dowel bars.

It should be appreciated that the number of groups and bars may be varied. For example, a typical design may be for a 24-foot wide concrete slab having 23 dowel bars spaced one foot apart with the two outside dowel bars six inches from the outside edge. To drop bars in this pattern, the DMF may be programmed with three groups. Groups 1 and 2 are programmed to drop 8 bars, and group 3 is programmed to drop 7 bars, for a total of 23 bars.

To drop 23 bars in the skewed pattern, DMF input switches 0, 20 and 3 would be on. DMF input switch 0 would be on to select skewed dowel bar placement and DMF input switches 20 and 3 would be on to indicate that a total of 23 bars are to be dropped.

One additional modification is required for dowel bar insertion in the skewed pattern. The inserter 62 must be adapted to extend across the frame 32 at the same angle as the transverse joint 12A to be cut. In other words, the inserter 62 must be skewed so that each set of forks 72 is positioned over its respective dowel bar 18. In other respects the skewed inserter is substantially the same as the straight inserter.

Of course, the skewed inserter requires more space under the frame 32 of the machine 30. Accordingly, it is advantageous to build the frame 32 with sufficient space between the feeder 60 and the center bar inserter 80 to accommodate the skewed inserter. In this manner, the same frame 32 may be used with either a straight or a skewed inserter.

Embodiment Of FIG. 19

In order to have all the capabilities described hereinabove, the machine 30 is a long, heavy piece of equipment. Accordingly, the machine 30 must be disassembled and loaded onto several transport trucks to be moved from one job site to another.

The time and effort required to disassemble, load, unload and reassemble the machine 30 is a definite disadvantage. The number of trucks needed to transport the machine 30 is also a drawback.

By providing all the paving functions in one package, the machine 30 has a complexity of controls and requires a large power unit. Designed to do the entire paving job, the machine 30 does not have versatility for use with other paving equipment.

Referring now to FIG. 19, shown therein and designated by reference numeral 30A is a paving machine which addresses these disadvantages of the paving machine 30. The paving machine 30A is constructed to distribute the concrete, consolidate the concrete, drop the dowel bars and insert the dropped dowel bars.

The paving machine 30A is operated in front of a finishing machine 30B, which strikes off and extrudes the concrete slab to a final grade. Basically, the paving machine 30A includes the front half of the paving machine 30 and the finishing machine 30B comprises the rear half of the paving machine 30. Like reference characters indicate like elements and features for the machines 30, 30A and 30B.

It should be appreciated that the paving machine 30A and the finishing machine 30B are separate, self-propelled machines, each having its own power, steering and control systems. As described hereinbelow, coordination of the speed and steering of the two machine 30A and 30B is required for proper operation.

The paving machine 30A includes a frame 32A mounted upon a front track assembly 34 and a rear track assembly 36 by a pair of front support columns 38 and a pair of rear support columns 40. The track assemblies 34 and 36 are adapted to propel the paving machine 30A over a surface prepared for the construction of a pavement.

The paving machine 30A illustrated in FIG. 19 is a four-track machine, which has a front track assembly 34 and a rear track assembly 36 on each side of the frame 32A. Alternatively, the paving machine may be a two-track machine 30C (FIG. 21) with a single track 208 on each side of the frame 32C.

Because the paving machine 30A is stopped while inserting dowel bars 18, the dowel bar inserter 62A of the paving machine 30A is different from the dowel bar inserter 62 of the paving machine 30. The dowel bar inserter 62A is rigidly mounted to the frame 32A and does not move between a forward position and a rearward position while the forks 72 insert the dowel bars 18.

Additionally, the dowel bar inserter 62A does not require the spades 188. In view of the fact that the dowel bar inserter 62A has no horizontal movement, the spades 188 are unnecessary.

The components of the finishing machine 30B have been described hereinabove. It should be appreciated that any conventional machine, rather than the finishing machine 30B, may be utilized in conjunction with the paving machines 30A or 30C. Regardless of the finishing machine utilized, it is important that the vibrator 84 neither extend so deep into the concrete slab nor operate with such force to disturb the inserted dowel bars 18.

Because the paving machine 30A and finishing machine 30B have separate and independent power units, control systems and steering systems, it is necessary that the paving machine 30A and the finishing machine 30B follow the same path precisely. In order to travel the same path, both the paving machine 30A and the finishing machine 30B may be equipped with sensors to trace a survey line or a stringline.

Stringline tracing systems are well known in the art and any suitable arrangement may be utilized to guide the paving machine 30A and the finishing machine 30B. For example, steering and elevation control systems for such machines are disclosed in U.S. Pat. Nos. 3,774,401 and 3,779,662, which are hereby incorporated by reference.

Drop-Then-Stop Operation

In operation, the paving machine 30A and the finishing machine 30B are driven forward with a properly maintained space between them. When the control system of the paving machine 30A determines that the paving machine 30A has reached a point for a dowel bar joint in the pavement, the paving machine 30A drops a set of dowel bars 18 across the concrete slab.

The paving machine 30A continues forward until the dowel bar inserter 62A is directly over the dropped dowel bars 18 and the paving machine 30A is stopped. Hydraulic power is then diverted from the drive system to the dowel bar insertion system of the paving machine 30A. Because the drive system and the dowel bar insertion systems of the paving machine 30A are not in use at the same time, the power requirements of the paving machine 30A are reduced by switching power between the drive system and dowel bar insertion system.

The forks 72 of the dowel bar inserter 62A are lowered to urge the dowel bars 18 into the concrete slab to a predetermined depth. It should be appreciated that the depth is measured upward from the grade beneath the concrete slab. Because the level of the machine 30A is controlled from a string line, measuring from the top of the concrete slab downward may be somewhat inaccurate. Moreover, the grade under the slab is uniform whereas the top of the preformed slab at machine 30A is typically not the same as the finished grade behind the finishing machine 30B.

Once the dowel bars 18 are inserted and the forks 72 raised, power is diverted back to the drive system of the paving machine 30A and the paving machine 30A is driven forward to the next dowel bar joint. The finishing machine 30B follows the paving machine 30B to insert center bars and apply a finished surface to the concrete slab. It should be appreciated that the center bar inserter 80 may be mounted to either the paving machine 30A or the finishing machine 30B.

The forward speeds of the paving machine 30A and the finishing machine 30B should be coordinated such that the machines 30A and 30B operate in tandem. During operation, the machines 30A and 30B should work reasonably close together. The finishing machine 30B should not be allowed to draw too close to the paving machine 30A, however, while the paving machine 30A is stopped for dowel bar insertion.

Figure 20:
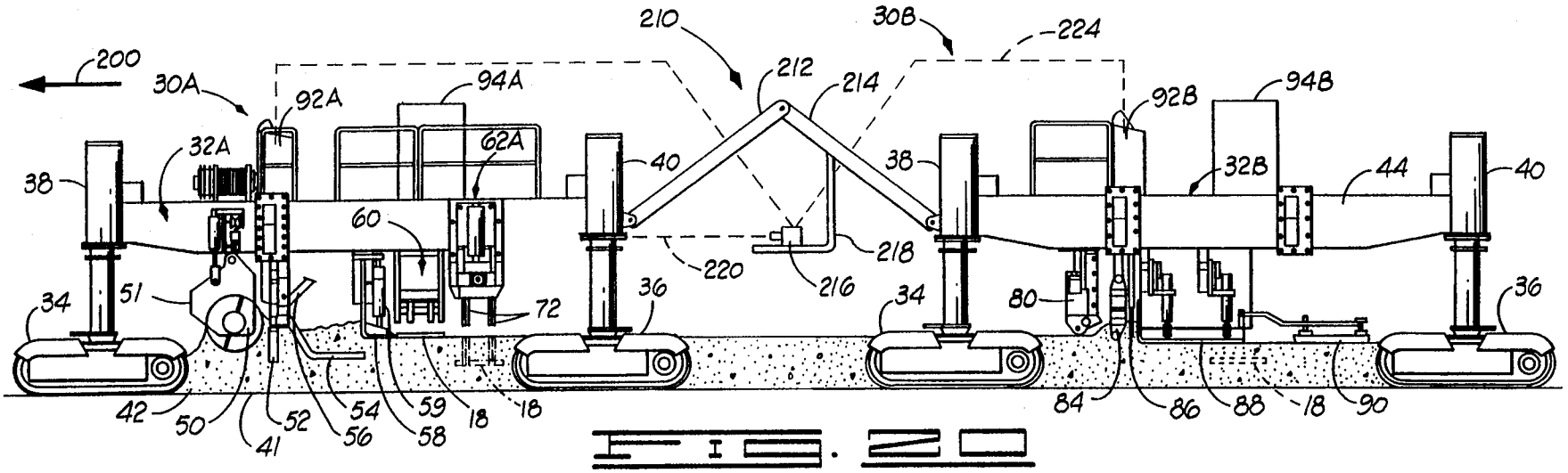
FIG. 20 is a partly diagrammatical side view of an alternate embodiment of the paving machine and finishing machine of FIG. 19, wherein the paving machine and the finishing machine are connected by a linking assembly for automatically maintaining a predetermined interval of space between the two machines.

Embodiment of FIG. 20

With reference now to FIG. 20, shown therein is another embodiment of the paving machine 30A and the finishing machine 30B. In this embodiment, the paving machine 30A and the finishing machine 30B are provided with a linking assembly 210 to control the spacing between the two machines 30A and 30B.

The linking assembly 210 includes a first link member 212, a second link member 214 and a distance sensor 216. One end of the first link member 212 is pivotally connected to the rear of the paving machine 30A. Similarly, one end of the second link member 214 is pivotally connected to the front of the finishing machine 30B. The other ends of the first link member 212 and the second link member 214 are pivotally attached to one another.

As the finishing machine 30B gains on the paving machine 30A, particularly while the paving machine 30A is stopped to insert dowel bars 18, the first link member 212 and the second link member 214 pivot upward. Conversely, when the finishing machine 30B and the paving machine 30B move farther apart, the first link member 212 and the second link member 214 pivot downward.

A sensor bracket 218 is mounted to the second link member 214 and extends below the first link member 212 and the second link member 214 to support the distance sensor 216. The distance sensor 216 is directed toward the rear of the paving machine 30A to provide a measurement (indicated by dashed line 220) which can be utilized to maintain an acceptable space between the paving machine 30A and the finishing machine 30B.

As indicated by the dashed line 222, the distance sensor 216 is connected to the drive control system at the operator's console 92A of the paving machine 30A. The drive control system for the paving machine 30A is programmed to compare the measurement of the distance sensor 216 with predetermined minimum and maximum limits. If the measurement of the distance sensor 216 is less than the minimum limit, the drive control system speeds up the paving machine 30A. If the measurement of the distance sensor 216 exceeds the maximum limit, then the drive control system slows the paving machine 30A down.

While the paving machine 30A is stopped to insert dowel bars 18, the finishing machine 30B continues forward and gains on the paving machine 30A. Shortening of the distance between the paving machine 30A and the finishing machine 30B is expected, normal operation during insertion. Of course, it is not desirable to speed up the paving machine 30A while it is stopped to insert dowel bars 18.

Accordingly, the drive control system is designed not to respond to the measurement of the distance sensor 216 during dowel bar insertion. As soon as dowel bar insertion is completed, the drive control system resumes its interaction with the measurement of the distance sensor 216. Typically, the measurement of the distance sensor 216 will be less than the minimum limit immediately after each stoppage of the paving machine 30A for dowel bar insertion. Thus the drive control system will speed up the paving machine 30A to achieve an acceptable distance between the two machines 30A and 30B after the insertion each set of dowel bars 18.

The distance sensor 216 may also be connected to the drive control system at the operator's console 92B of the finishing machine 30B (as indicated by dashed line 224). With this arrangement, the measurement of the distance sensor 216 may be utilized to automatically speed up or slow down the finishing machine 30B as well as the paving machine 30A.

The measurement of the distance sensor 216 may also be used to recognize an emergency situation, where the machines 30A or 30B should be stopped immediately. If the measurement of the distance sensor 216 is less than a predetermined emergency minimum distance, then machines 30A and 30B are dangerously close together. In this case, the drive control system at console 92B immediately stops the finishing machine 30B.

On the other hand, if the measurement of the distance sensor 216 exceeds a predetermined emergency maximum distance, the drive control system at 92A immediately stops the paving machine 30A. In this manner, the paving machine 30A is stopped before the linking assembly 210 is damaged.

Figure 21:
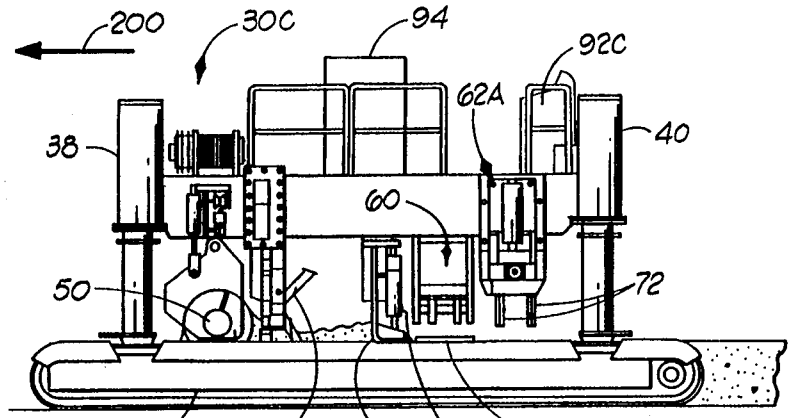
FIG. 21 is a partly diagrammatical side view of another embodiment of the paving machine shown in FIGS. 19 and 20.

Embodiment of FIG. 21

Referring now to FIG. 21, shown therein and designated by reference character 30C is a two-track embodiment of the paving machine with dowel bar insertion. By separating the slab-forming and dowel bar insertion components from the structure for finishing the paved surface, the paving machine 30C may be compact enough to be supported upon two tracks rather than four tracks.

Furthermore, the console 92C of the paving machine 30C is located toward the rear of the paving machine 30C such that the operator faces rearward when operating the paving machine 30C. With this arrangement, the operator of the paving machine 30C has a close and unobstructed view of the finishing machine 30B. It should be appreciated that either the four-track paving machine 30A or the two-track paving machine 30C may be constructed with a console positioned for a rearward-facing operator.

Troughing Feature

As mentioned hereinabove, the concrete must be consolidated to a consistency which will support the dowel bars when the dowel bars are dropped onto the concrete. In being firm enough to support the dowel bars, however, the concrete may allow the dowel bars to roll after being dropped.

In some instances, a dowel bar may roll on the surface of the concrete in a direction parallel to its correct position. In other cases, one end of a dowel bar may roll to pivot the dowel bar on the concrete about its opposite end.

Of course, both of these situations wherein a dowel bar rolls are undesirable. If a dowel bar rolls very far out of its correct position, it will not be placed where the corresponding insertion forks move downward to urge it into the concrete.

Figure 22:
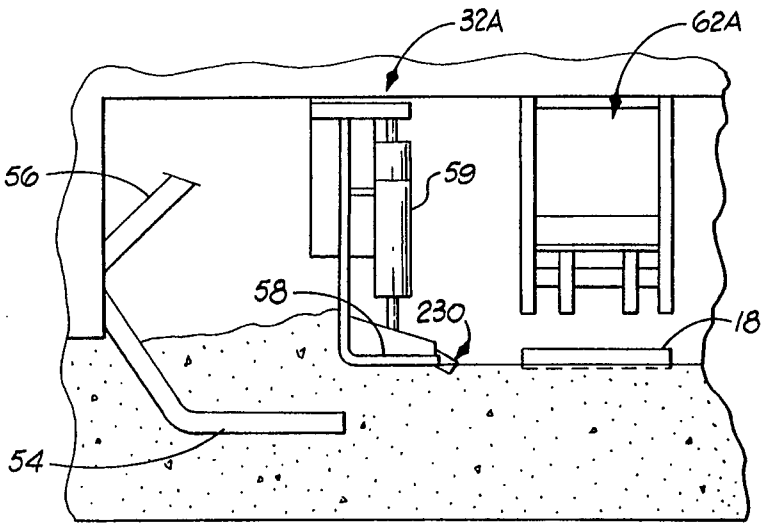
FIG. 22 is an enlarged, partly diagrammatical side view of a middle portion of the paving machines of FIGS. 19 through 21, illustrating the troughing assembly.

In order to prevent the dropped dowel bars from rolling, the paving machines 30A and 30C may be constructed with a concrete troughing assembly 230. As illustrated by FIG. 22, the troughing assembly 230 is attached to the rear of the metering screed 58 to make a plurality of shallow troughs across the top surface of the concrete slab. The troughs are spaced to match the dowel bar pattern of the dowel bar feeder 60 and the dowel bar inserter 62A.

When the dowel bars 18 are dropped, each dowel bar 18 settles into its appropriate trough, as indicated by the dashed portion of the dowel bar 18 in FIG. 22. By providing a trough for each dowel bar 18, none of the dowel bars 18 rolls out of its correct position for being placed into the concrete by the insertion forks 72.

Figure 23:
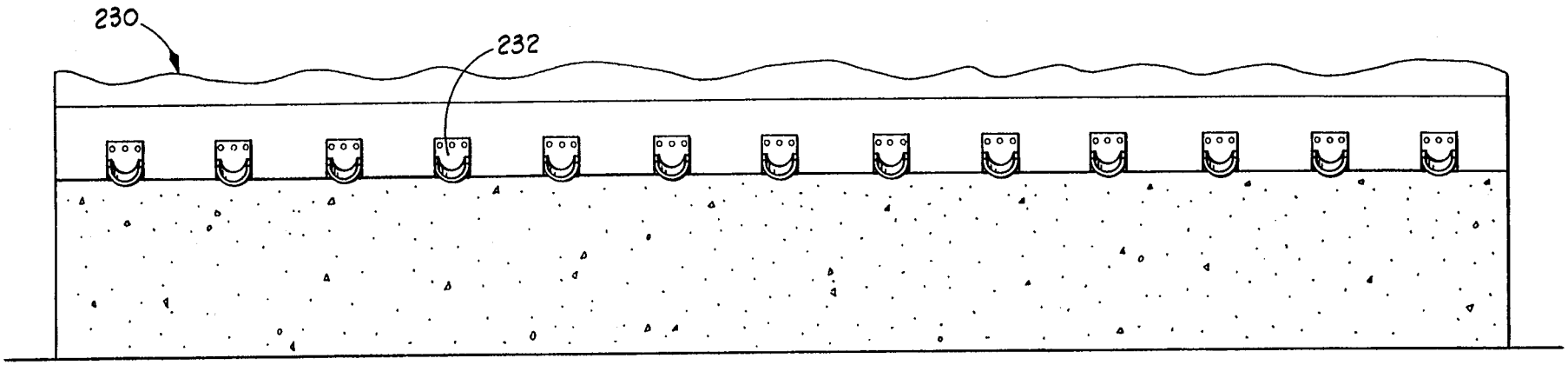
FIG. 23 is partly diagrammatical rear view of the troughing assembly of FIG. 22.
Figure 25:
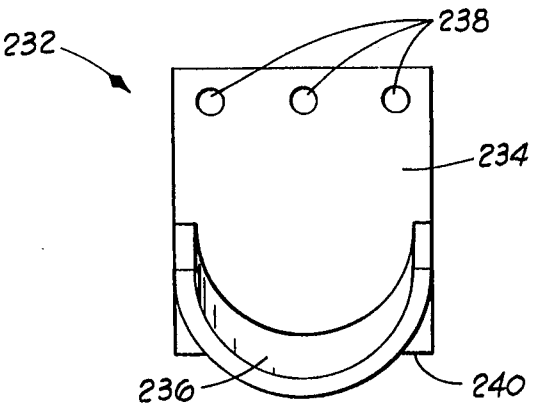
FIG. 25 is a rear view of one of the troughing member shown in FIG. 24.
Figure 24:
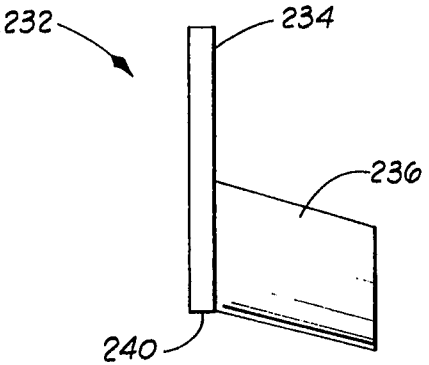
FIG. 24 is a side view of one of the troughing members of the troughing assembly of FIG. 23.

Turning now to FIGS. 23 through 25, shown therein is the troughing assembly 230 in greater detail. As best shown in FIG. 23, the troughing assembly 230 comprises a plurality of troughing members 232 which are spaced apart to match the desired dowel bar insertion pattern. It should be appreciated that the size of each troughing member 232 is exaggerated in FIG. 23 for purposes of illustration.

Each troughing member 232 extends angularly rearward and downward from the metering screed 58 to produce a trough in concrete as the metering screed 58 moves forward with the paving machine 30, 30A or 30C. It should be understood that each trough need only be deep enough to keep a dowel bar 18 from rolling. Typically, the troughs are in the range of one to three inches deep at their deepest point.

Furthermore, the troughs are typically semi-cylindrical in shape to cradle the dowel bars 18. The troughs may have any diameter which is sufficient to keep the dowel bars 18 from rolling on the consolidated, preformed concrete surface. It should be appreciated that any shape of troughs (V-shaped, rectangular or the like) consistent with preventing dowel bar 18 rolling may be utilized with any embodiment of paving machine disclosed herein.

With reference to FIGS. 24 and 25, shown therein is one of the troughing members 232 separately. Each troughing member 232 comprises a mounting plate 234 and a trowel member 236. The mounting plate 234 has a plurality of mounting holes 238 for bolting attachment of the troughing member 232.

Typically, each trowel member 236 is a semi-cylindrical pipe, which is skewed from front to rear to protrude angularly from its mounting plate 234. Each trowel member 236 is welded to or casted with its mounting plate 234 to extend downward and rearward from the mounting plate 234. Thus each trowel member 236 protrudes angularly below the bottom edge 240 of its mounting plate 234.

When the troughing assembly 230 is mounted to the metering screed 58, the bottom edge 240 of each mounting plate 234 is aligned with the bottom of the metering screed 58 (FIG. 23). Accordingly, each trowel member 236 extends angularly below the metering screed 58 into an uppermost portion of the concrete slab.

As the metering screed 58 moves forward, each trowel member 236 is towed through the concrete to produce a shallow trough in the top surface of the concrete. As described hereinabove, the correct position for each dowel bar 18 lies in a corresponding one of the troughs.

When the dowel bars 18 are dropped, each dowel bar 18 settles into a corresponding one of the troughs to prevent any rolling by the dowel bar 18. Thus the troughs ensure that the dowel bars 18 are in their correct positions for being inserted into the concrete slab by the insertion forks 72. As mentioned hereinabove, the troughs are shallow and are readily smoothed out by the finishing machine 30B.

Changes may be made in the combinations, operations and arrangements of the various parts and elements described herein without departing from the spirit and scope of the invention as defined in the following claims.

What is claimed is:

1. An apparatus for inserting dowel bars into an unhardened pavement, the apparatus comprising:

a frame having a front end and a rear end, said frame being adapted for forward movement;

a fork rack carried by said frame, said fork rack being horizontally stationary with respect to said frame and having a plurality of insertion forks arranged in a predetermined pattern;

a dowel bar feeder carried by said frame and adapted to drop a plurality of dowel bars in the predetermined pattern in front of said fork rack; and means for vertically moving said fork rack while said frame is stopped between a storage position, wherein the insertion forks are spaced a distance from the unhardened pavement, and an inserting position, wherein the insertion forks engage the dropped dowel bars and urge the dropped dowel bars into the unhardened pavement to a predetermined depth.

2. The apparatus of claim 1 wherein said fork rack and said dowel bar feeder are detachable from said frame.

3. The apparatus of claim 1 wherein said fork rack extends perpendicularly across the frame and wherein each set of dowel bars is dropped onto and across the concrete in a pattern substantially perpendicular to the direction of forward travel of said frame.

4. The apparatus of claim 1 wherein said dowel bar feeder drops all of the dowel bars of each set at one time.

5. The apparatus of claim 1 wherein said fork rack extends across the unhardened pavement at an oblique angle and wherein each set of dowel bars is dropped onto the unhardened pavement in a skewed pattern.

6. The apparatus of claim 5 further comprising:

means for dropping the dowel bars of each set one at a time to form the skewed pattern across the unhardened pavement.

7. The apparatus of claim 1 wherein said dowel bar feeder is operable from either side of said frame.

8. The apparatus of claim 1 wherein said dowel bar feeder has a detachable dowel bar magazine.

9. The apparatus of claim 1 further comprising:

a plurality of troughing members carried by said frame, said troughing members being positioned and arranged to produce a plurality of troughs in the upper surface of the concrete in front of said dowel bar feeder, each one of the troughs being shaped and located to receive at least a portion of a corresponding one of the dowel bars when the dowel bars are dropped by said dowel bar feeder.

10. The apparatus of claim 1 further comprising:

a finishing machine coupled to the rear end of said frame, said finishing machine being adapted to smooth the unhardened concrete to a finish grade.

11. The apparatus of claim 10 further comprising:

means for maintaining a distance interval between said finishing machine and the rear end of said frame of the paving machine, the distance interval being within predetermined upper and lower limits.

12. A method of inserting dowel bars into unhardened pavement, the steps of the method comprising:

(a) providing a paving machine carrying a dowel bar feeder and a fork rack, the dowel bar feeder being forward of the fork rack and the fork rack having a plurality of insertion forks;

(b) dropping a plurality of dowel bars from the dowel bar feeder in a predetermined pattern across an unhardened pavement;

(c) propelling the paving machine forward until each one of the insertion forks is positioned substantially over a corresponding one of the dropped dowel bars;

(d) stopping the paving machine with each one of the insertion forks positioned substantially over a corresponding one of the dropped dowel bars; and (e) lowering the fork rack until each one of the insertion forks engages the corresponding dowel bar and urges the corresponding dowel bar to a predetermined depth into the unhardened pavement.

13. The method of claim 12 further comprising the step of:

consolidating the unhardened concrete pavement before step (a) until the unhardened concrete pavement has a consistency for retaining the dowel bars upon the upper surface of the unhardened concrete pavement substantially in the position dropped.

14. The method of claim 12 further comprising the step of:

vibrating the insertion forks during step (e) after the insertion forks engage the dropped dowel bars.

15. The method of claim 12 further comprising the step of:

raising the fork rack after step (e) to position the insertion forks a distance above the unhardened pavement.

16. The method of claim 15 further comprising the step of: vibrating the insertion forks while raising the fork rack.

17. The method of claim 12 wherein step (b) is performed by dropping one dowel bar at a time in sequence while propelling the paving machine forward to drop dowel bars across the unhardened pavement in a skewed pattern.

18. The method of claim 12 wherein step (b) is performed by dropping the plurality of dowel bars at the same time in a substantially straight pattern across the unhardened pavement.

19. The method of claim 12 further comprising the steps of:

metering a predetermined volume of unhardened concrete in front of the dowel bar feeder; and striking off a predetermined width and depth of unhardened concrete in front of the dowel bar feeder.

20. The method of claim 12 further comprising the step of: vibrating an upper layer of the unhardened concrete without disturbing the inserted dowel bars.

21. The method of claim 20 further comprising the step of:

tamping an upper layer of the unhardened concrete without disturbing the inserted dowel bars.

22. The method of claim 21 further comprising the step of:

extruding the upper surface of the unhardened concrete after the tamping step to produce a final grade in the unhardened concrete.

23. The method of claim 22 further comprising the step of:

smoothing the upper surface of the unhardened concrete after the extruding step to produce a finished grade concrete surface.

24. The method of claim 12 further comprising the step of:

producing a plurality of troughs in the upper surface of the unhardened concrete, each one of the troughs being shaped and located to receive at least a portion of a corresponding one of the dowel bars when the dowel bars are dropped onto the unhardened concrete.

25. The method of claim 12 further comprising the step of:

providing a finishing machine to follow the paving machine and to produce a final consolidated concrete surface.

26. The method of claim 25 further comprising the step of:

providing a distance sensor to determine a measured distance between the paving machine and the finishing machine.

27. The method of claim 26 further comprising the step of:

adjusting the rate of movement of the paving machine when the measured distance is outside predetermined limits until the measured distance is within the predetermined limits.

28. The method of claim 26 further comprising the step of:

adjusting the rate of movement of the finishing machine when the measured distance is outside predetermined limits until the measured distance is within the predetermined limits.

* * * * *

UNITED STATES PATENT AND TRADEMARK OFFICE

CERTIFICATE OF CORRECTION

PATENT NO. : 5,405,212
DATED : April 11, 1995
INVENTOR(S) : George W. Swisher Jr., It is certified that error appears in the above-indentified patent and that said Letters Patent is hereby corrected as shown below:

On the title page item [57], line 12, after "bar", "inserted" should be --inserter--.

Column 2, line 28, after "pan", "," should be --.--.

Column 2, line 32, after "process", "," should be --.--.

Column 2, line 36, after "process", "," should be --.--.

Column 2, line 40, after "claims", "," should be --.--.

Column 4, line 8, "Spacing" should be --spacing--.

Signed and Sealed this

Twenty-ninth Day of August, 1995

*Attest:*

*Attesting Officer*

BRUCE LEHMAN

*Commissioner of Patents and Trademarks*